US012302994B2

(12) United States Patent
Redon et al.

(10) Patent No.: US 12,302,994 B2
(45) **Date of Patent: *May 20, 2025**

(54) OUTSOLE PATTERN FOR AN ARTICLE OF FOOTWEAR

(71) Applicant: PUMA SE, Herzogenaurach (DE)

(72) Inventors: Arnaud Redon, Nuremberg (DE); Christopher Dunning, Herzogenaurach (DE)

(73) Assignee: PUMA SE, Herzogenaurach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 18/505,674

(22) Filed: Nov. 9, 2023

(65) Prior Publication Data

US 2024/0074542 A1 Mar. 7, 2024

Related U.S. Application Data

(63) Continuation of application No. 17/396,912, filed on Aug. 9, 2021, now Pat. No. 11,819,088.

(51) Int. Cl.
*A43C 15/02* (2006.01)
*A43B 13/14* (2006.01)

(52) U.S. Cl.
CPC ..... *A43C 15/02* (2013.01); *A43B 13/141* (2013.01)

(58) Field of Classification Search
CPC ..... A43B 13/141; A43B 13/181; A43B 13/04; A43B 3/0042
See application file for complete search history.

(56) References Cited

U.S. PATENT DOCUMENTS

D234,930 S * 4/1975 Arambasic ..... D2/955
4,266,349 A * 5/1981 Schmohl ..... A43B 13/223 D2/947
4,347,674 A * 9/1982 George ..... A43C 13/04 36/67 R
D275,146 S * 8/1984 Kilgore ..... D2/955
4,541,186 A * 9/1985 Mulvihill ..... A43B 5/00 36/43
4,571,852 A * 2/1986 Lamarche ..... A43B 13/223 D2/951
4,653,206 A * 3/1987 Tanel ..... A43B 3/0042 36/134
4,670,997 A * 6/1987 Beekman ..... A43B 13/223 36/114
D298,883 S * 12/1988 Tanel ..... D2/949
5,201,126 A * 4/1993 Tanel ..... A43B 3/0042 36/134
D396,549 S * 8/1998 von Conta ..... D2/955
5,906,059 A * 5/1999 Singer ..... A43C 15/164 36/134
6,016,613 A * 1/2000 Campbell ..... A43B 5/001 D2/906
D618,895 S * 7/2010 Wolff ..... D2/954
7,762,009 B2 * 7/2010 Gerber ..... A43B 13/26 36/59 C (Continued)

*Primary Examiner* — Bao-Thieu L Nguyen
(74) *Attorney, Agent, or Firm* — Quarles & Brady LLP

(57) ABSTRACT

An outsole includes a set of ridges concentrically aligned around and emanating outwardly from a first epicenter. Each of the ridges have an undulating height there along. A portion of the set of ridges is aligned to define a flex zone. The flex zone is configured to accommodate flexion of the outsole there along.

25 Claims, 15 Drawing Sheets

(56) References Cited

U.S. PATENT DOCUMENTS

| | | | | |
|---|---|---|---|---|
| 8,011,118 | B2 * | 9/2011 | Gerber | A43B 3/0042 36/59 C |
| 10,034,520 | B1 * | 7/2018 | Jafarifar | A43C 15/167 |
| 10,278,455 | B2 * | 5/2019 | Minami | A43B 13/223 |
| D923,922 | S * | 7/2021 | Winskowicz | D2/947 |
| D929,097 | S * | 8/2021 | Winskowicz | D2/962 |
| 11,206,893 | B2 * | 12/2021 | Winskowicz | A43B 7/1425 |
| 11,819,088 | B2 * | 11/2023 | Redon | A43B 13/181 |
| 2008/0098624 | A1 * | 5/2008 | Goldman | A43C 15/16 36/126 |
| 2011/0252669 | A1 * | 10/2011 | Kasprzak | A43B 13/223 36/67 A |
| 2020/0128913 | A1 * | 4/2020 | Loverin | A43B 13/184 |
| 2020/0315285 | A1 * | 10/2020 | Winskowicz | A43B 7/1425 |

* cited by examiner

OUTSOLE PATTERN FOR AN ARTICLE OF FOOTWEAR

CROSS REFERENCE TO RELATED APPLICATIONS

This application is a continuation of U.S. patent application Ser. No. 17/396,912, filed on Aug. 9, 2021, which is incorporated by reference herein in its entirety.

FIELD OF THE DISCLOSURE

The present disclosure generally relates to a sole for an article of footwear and, more particularly, to an outsole for an article of footwear including a pattern that may provide omnidirectional traction and impart differential stiffness properties.

BACKGROUND

Many conventional shoes or other articles of footwear generally comprise an upper and a sole attached to a lower end of the upper. Conventional shoes further include an internal space, i.e., a void or cavity, which is created by interior surfaces of the upper and the sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and an insole. The outsole may provide traction to a ground engaging surface of the sole, and the midsole may be attached to an upper surface of the outsole to provide cushioning or added stability to the sole. For example, a sole may include a particular foam material that may increase stability at one or more desired locations along the sole, or a foam material that may reduce stress or impact energy on the foot or leg when a user is running, walking, or engaged in another activity.

With respect to athletic shoes, such as soccer cleats for example, a sole assembly may include an outsole formed from one or more materials to impart durability, wear-resistance, abrasion resistance, or traction to the article of footwear. In some cases, an outsole of an athletic shoe may have properties that influence the bending stiffness on the article of footwear.

In recent years, the influence of shoe sole bending stiffness on a wearer's athletic performance has been investigated, and several studies have shown that shoes having relatively stiff soles may reduce the metabolic cost of running and/or provide spring-like properties to aid in running propulsion. In some conventional arrangements, athletic shoes can include stiffening components that may be embedded within the sole to increase the overall bending stiffness of the sole. However, including additional components within the sole assembly can increase the complexity of manufacturing and the end-user cost for the shoe. Further, additional studies have suggested that restricting flexion of the foot in certain areas, such as at the toes, can negatively affect user performance.

The anatomy of a foot includes various bones, joints, and movements that are sensitive to the structure and performance of a foot. For example, this sensitivity can be described as proprioception, also known as a "sixth sense," which involves the perception or awareness of the position and movement of one's body. It can be advantageous to design an article of footwear that enhances a person's proprioception by delivering comfort and flexibility in certain areas, providing rigidity and stiffness where needed, and accommodating the natural movement and flexion of a foot inside of an article of footwear.

Athletic shoes have also long been known to include means for improving traction with the ground, and it is well known that certain tread configurations may be configured to provide performance advantages. The soles of shoes for court sports, e.g., basketball, have been provided with a variety of tread designs for enhancing traction to enable fast starting, stopping, and turning. In sports such as baseball, football, soccer, and the like, which are played on turf or grass, the corresponding athletic shoes often include a plurality of ground engaging members (e.g., spikes, studs, blades, or cleats), which provide the desired traction and may facilitate rapid changes in direction.

Ground engaging members for athletic shoes may include a wide variety of configurations depending on the surface for which the cleats or shoes are intended to be used. For example, athletic shoes may be configured for use on firm ground, soft ground, artificial turf, street surfaces, or indoor courts (e.g., futsal courts). Firm ground cleats, which are primarily used on natural grass and outdoor fields, may include non-removable cleats or studs designed to provide traction and stability. Soft ground cleats typically have longer studs for improved traction on wet or muddy ground and may further include metal-tipped and/or detachable studs to allow for customization to suit varying field conditions. Street cleats and turf shoes usually have rubber outsoles and may include smaller rubber studs that protrude outwardly from the outsole to improve traction.

Ground engaging members (e.g., cleats or studs) are often conical-shaped, blade-shaped, chevron-shaped, or a combination or variation thereof, and each shape is known to provide certain performance advantages. Conical studs, for example, may provide omnidirectional traction to facilitate movements in all directions due to the cylindrical shape of the outer surface. Blade-shaped or chevron-shaped cleats are typically better suited for aiding traction and acceleration along a particular direction due to the planar configuration of the cleat faces. Further, the spatial distribution of the ground engaging members can also influence the outsole's performance. Additionally, configurations of ground engaging members may be optimized for different purposes, for example, improving traction in a particular direction or improving general responsiveness.

In light of the above, in many cases it would be desirable for an athletic shoe to include an outsole having zones with different bending characteristics. Further, athletic shoes that provide a tread design for improved traction and comfort are also desired.

SUMMARY

An article of footwear, as described herein, may have various configurations. The article of footwear may have an upper and an outsole connected to the upper. In some embodiments, the article of footwear may also include additional components, such as a midsole, and an insole.

In one aspect, the present disclosure provides an outsole for an article of footwear. The outsole can include a set of ridges concentrically aligned around and emanating outwardly from a first epicenter.

In some embodiments, the flex zone can be configured to correspond with a location of a metatarsal-phalangeal joint of a wearer. The flex zone can extend from a medial side of the outsole to a lateral side and through the first epicenter. Each of the ridges can have an undulating height there along. A portion of the set of ridges can be aligned to define a flex zone configured to accommodate flexion of the outsole there along.

In some embodiments, each of the ridges is circular.

In some embodiments, the flex zone can be configured to correspond with a location of a metatarsal-phalangeal joint of a wearer. The flex zone can extend from a medial side of the outsole to a lateral side and through the first epicenter.

In some embodiments, the outsole can include a different set of ridges concentrically aligned around and emanating outwardly from a second epicenter in a heel region. Each of the ridges can have an undulating height there along. A portion of the different set of ridges can be aligned to define a stiffening zone. The two sets of ridges can overlap in the stiffening zone.

In another aspect, the present disclosure provides an outsole for an article of footwear. The outsole can include a set of ridges concentrically aligned around emanating outwardly from an epicenter in a heel region. Each of the set of ridges can have a height undulating between tall and short portions there along. The tall portions of the set of ridges can be aligned to define a stiffening zone.

In some embodiments, the stiffening zone can extend along a center of pressure applied by a wearer's foot.

In some embodiments, the outsole can include a different set of ridges concentrically aligned around and emanating outwardly from an epicenter in a forefoot region. Each of the ridges can have a height undulating between tall and short portions there along. The short portions of the different set of ridges can be aligned to define a flex zone configured to accommodate flexion of the outsole there along. The two sets of ridges can overlap in the stiffening zone. The tall portions of the two sets of ridges overlap within the stiffening zone.

In another aspect, the present disclosure provides an outsole for an article of footwear with a forefoot region, a heel region, a medial side, and a lateral side. The outsole can include a ground engaging surface defining a plurality of ridges. The plurality of ridges can include a first set of ridges concentrically aligned about a first epicenter and a second set of ridges concentrically aligned about a second epicenter. Each of the first set of ridges and the second set of ridges can have a height undulating between at least one tall portion and short portion there along.

In some embodiments, the first set of ridges can be aligned to define a flex zone configured to accommodate flexion of the outsole there along. The tall portion of the second set of ridges can be aligned to define a stiffening zone.

In some embodiments, the tall portions of the first set of ridges and the second set of ridges can be aligned in the stiffening zone. The first set of ridges can overlap with the second set of ridges in the stiffening zone.

In some embodiments, the outsole can include a first set of cleats that can be concentrically distributed around the first epicenter at a first radial distance. The first set of cleats can be aligned along a ridge of the first set of ridges. The first set of cleats can be integrally formed with the ridge of the first set of ridges. A second set of cleats that can be concentrically distributed about the second epicenter at a second radial distance from the first epicenter. A third set of cleats can be concentrically distributed about the first epicenter at a third radial distance from the first epicenter. The third radial distance can be greater than the first radial distance. A fourth set of cleats can be radially distributed about the first epicenter at a fourth radial distance from the first epicenter. The fourth radial distance can be greater than the third radial distance. The second radial distance can be greater than the first, third, and fourth radial distances.

In some embodiments, a location of the first epicenter can be configured to correspond with a location of a first metatarsal joint of a wearer.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

Figure 1:
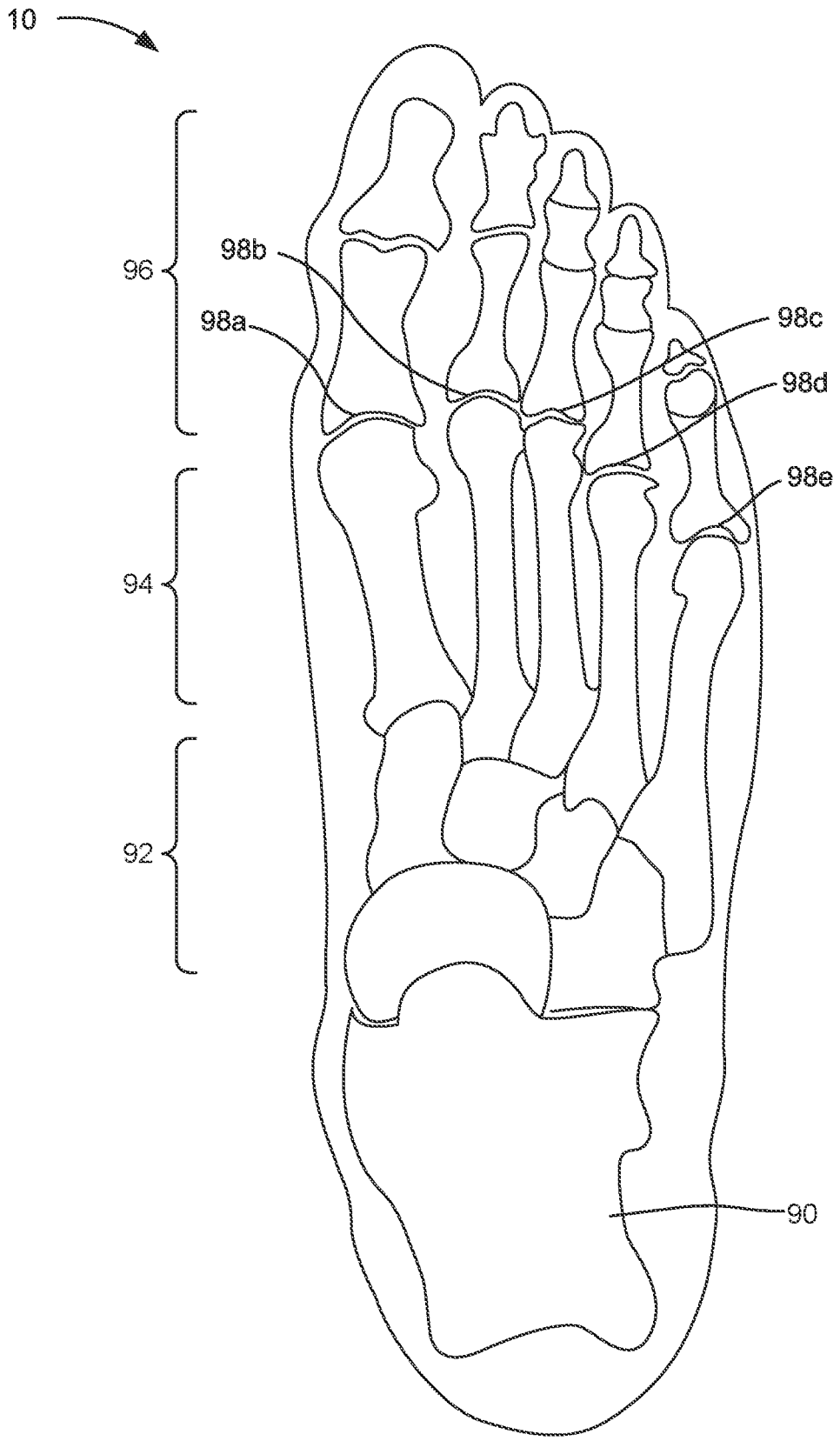
FIG. 1 is a top view showing the bones and joints of the human foot for explaining certain principles of the present disclosure.

The following discussion and accompanying figures disclose various embodiments or configurations of a shoe and a sole structure. Although embodiments of a shoe or an outsole for a shoe are disclosed with reference to an article of athletic footwear, such as a soccer cleat or football cleat, concepts associated with the shoe or outsole of the present disclosure may be applied to a wide range of footwear and footwear styles, including running shoes, tennis shoes, basketball shoes, cross-training shoes, football shoes, golf shoes, hiking shoes, hiking boots, ski and snowboard boots, walking shoes, and track cleats, for example. Concepts of the shoe or outsole could also be applied to articles of footwear that are considered non-athletic, including dress shoes, sandals, loafers, slippers, and heels.

The present disclosure is generally directed to an article of footwear and/or specific components of the article of footwear, such as a sole or outsole that may be connected to an upper. The configuration of the sole or outsole may vary significantly in different embodiments to include a variety of conventional or non-conventional structures. Generally, the sole extends between the upper and the ground when the article of footwear is worn. In different embodiments, the sole may include different components. For example, the sole may include an outsole, a midsole, and/or an insole. In some cases, one or more of these components may be optional. As such, the article of footwear may comprise an outsole and any one or a combination of an upper, a midsole, an insole, an outsole plate, ground engaging members, supportive inserts, and any combination of structural accessories that are known in the prior art.

Generally, the upper may be any type of upper. In particular, the upper may have any design, shape, size and/or color. For example, in embodiments where the article of footwear is a soccer shoe, the upper may be a low top upper. In embodiments where the article of footwear is a football shoe, the upper may be a high top upper that is shaped to provide high support on an ankle.

The upper may comprise a knitted component, a woven textile, a non-woven textile, a natural material (e.g., leather or synthetic variants thereof), mesh, suede, or a combination of one or more of the aforementioned materials. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

As used herein in the context of geometric descriptions, unless otherwise limited or defined, "substantially" indicates correspondence to a particular shape or dimension within conventional manufacturing tolerances for components of a similar type or that are formed using similar processes. In this regard, for example, "substantially round" or "substantially circular", can indicate a profile that deviates from a circle to within acceptable manufacturing tolerances.

As used herein, the term "ground engaging members" may relate to, or may be used interchangeably with any provisions disposed on a sole or outsole for increasing traction through friction or penetration of a ground surface, including, but not limited to cleats, studs, projections, or treads. Typically, ground engaging members may be configured for football, soccer, baseball or any type of activity that requires traction with a ground surface. In some embodiments for outsoles described herein, the outsoles can include ground engaging members comprising cleats or studs. Generally, the ground engaging members may be associated with sole or outsole structure in any manner. For example, in some embodiments, ground engaging members may be integrally formed with the sole or outsole, and, in some cases, ground engaging members may be attached to the outsole body.

The terms "omnidirectional traction" and "directional traction" may be used herein to describe the nature or quality of the traction provided by a ground engaging member. For example, a ground engaging member may be described as providing "omnidirectional traction" when the ground engaging member provides traction for facilitating movements in many directions. A ground engaging member may be described as providing "directional traction" when the ground engaging member is suitable for providing traction along one direction or a pair of opposed directions. For example, a ground engaging member that suitably provides traction in one or both of the forward and backward directions may be described herein as providing "directional traction". These terms are used to demonstrate exemplary functions of described outsole structures, but no one structure should necessarily be limited to one or either of these functions as numerous structural differences could exist between various outsole embodiments without departing from the teachings of the this disclosure, and such structural differences may result in different functions.

As used herein, unless otherwise defined or limited, directional terms are used for convenience of reference for discussion of particular figures or examples. For example, references to "downward," or other directions, or "lower" or other positions, may be used to discuss aspects of a particular example or figure, but do not necessarily require similar orientation or geometry in all installations or configurations.

The terms first, second, third, etc. may be used herein to describe various elements, components, regions, layers, and/or sections. These elements, components, regions, layers and/or sections should not be limited by these terms. These terms may be only used to distinguish one element, component, region, layer, or section from another region, layer, or section. Terms such as "first," "second," and other numerical terms do not imply a sequence or order unless clearly indicated by the context. Thus, a first element, component, region, layer, or section discussed below could be termed a second element, component, region, layer, or section without departing from the teachings of the example configurations.

Before outsoles in accordance with the present disclosure are discussed in detail, reference is made to a skeleton of a human foot 10 shown in FIG. 1. The foot 10 includes the calcaneus bone 90, tarsal bones 92, metatarsal bones 94, and phalanges 96. The metatarsal bones 94 connect to the toes or phalanges 96 at the metatarsal-phalangeal joints 98*a*-98*d* (or 98, collectively).

During running activities, and as the foot 10 pushes off from the ground, the tarsal bones 92 and metatarsal bones 94 in the arch of the foot naturally lock together to perform the function of a lever arm and propel the leg forward. However, some energy is dissipated through slight movements that occur between the tarsal bones 92 and metatarsal bones 94, thereby causing inefficient propulsion.

The metatarsal-phalangeal joints 98 also provide a key role in running, jumping, and cutting activities. For example, peak plantar pressures occur beneath the first metatarsal-phalangeal joint 98*a* (a.k.a. the "big-toe joint") during various athletic activities, and joints 98*a*-98*e* collectively allow the toes to bend to provide balance and propulsion to a user while running. Further, the first metatarsal-phalangeal joint 98*a* often acts as a fulcrum about which rotational and pivotal movements of the foot 10 occur.

In some embodiments, outsoles of an article of footwear can include a surface pattern comprising a plurality of circular ridges, as will be described in later portions of this disclosure. The surface pattern is configured to increase the bending stiffness of the outsole in certain areas of the outsole, while accommodating for increased flexibility in other areas. In some embodiments, the structure of the surface pattern increases the bending stiffness of the outsole in the general area corresponding to the arch of the foot of a user, and the surface pattern provides increased flexibility in another area of the outsole to, for example, accommodate flexion of the toes. Further, in some embodiments, the surface pattern may provide traction with the ground and facilitate rapid pivotal movements about the first metatarsal phalangeal joint 98*a*. Outsoles of the present disclosure may form a bottom portion of the article of footwear, such that the outsole is disposed between the foot of a user and the ground when the article is worn by a user. In some embodiments, the outsoles may comprise one or more body portions.

With reference to FIGS. 2-7, the present disclosure provides an article of footwear 100 (partially shown in FIGS. 5 and 6) that includes an outsole 102. The outsole 102 comprises an outsole body 104 having a toe end 106, a heel end 108, a top surface 110 (shown in FIGS. 5 and 7), and a ground engaging surface 112 disposed opposite the top surface 110. The top surface 110 may connect with or secure to another component of the article 100, such as an upper or a midsole. The ground engaging surface 112 is configured to interface with the ground and provide traction. The ground engaging surface 112 includes a surface pattern 114 comprising a plurality of circular ridges 116.

Figure 4:
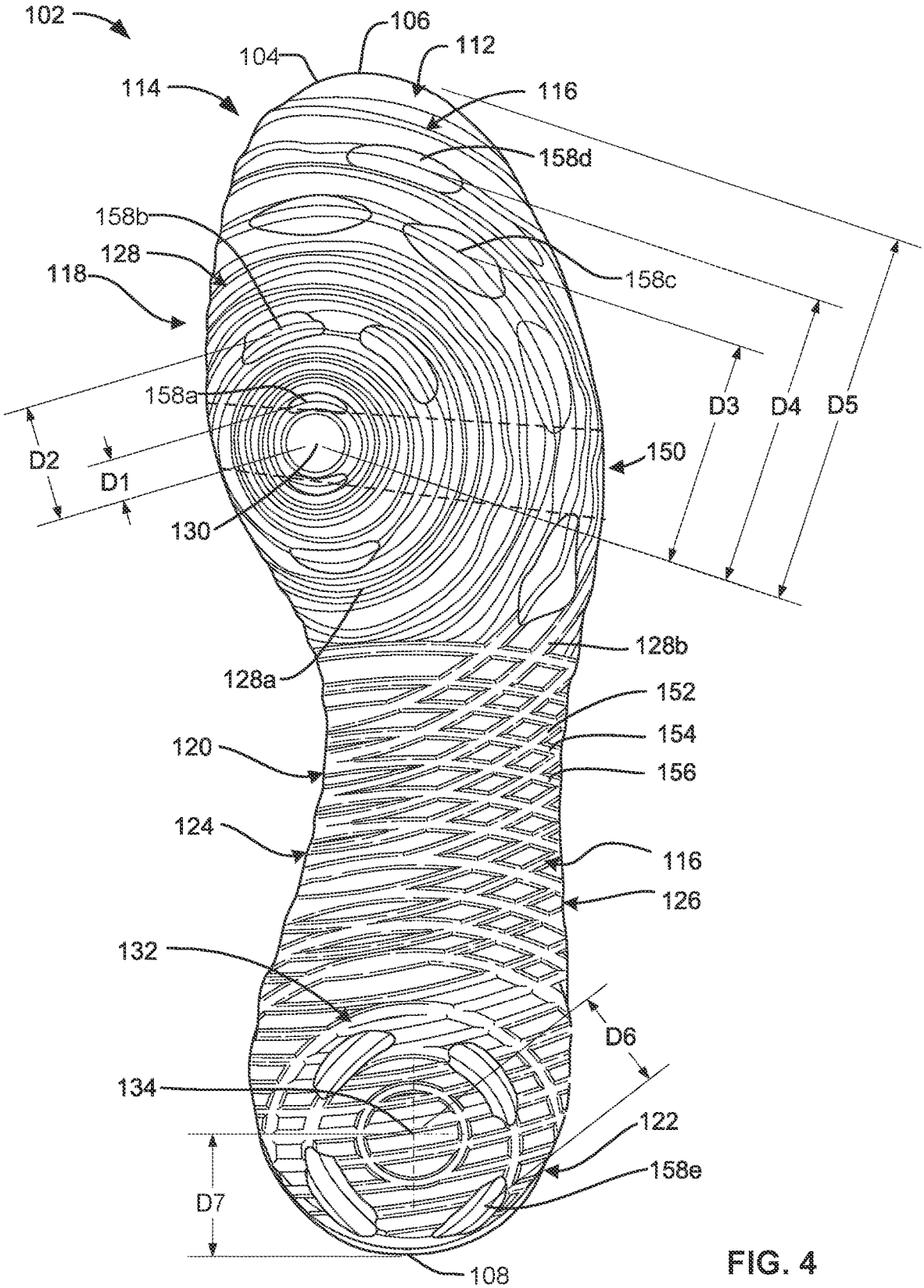
FIG. 4 is a bottom plan view of the outsole of FIG. 2.

Referring to FIG. 4, the outsole 102 generally defines a forefoot region 118, a midfoot region 120, and a heel region 122. The forefoot region 118 generally corresponds with portions of the article 100 that encase the phalanges 96 (or toes) of the foot 10 and the metatarsal-phalangeal joints 98 (a.k.a. the ball of the foot), which is a joint between the toes 96 and metatarsal bones 94 of the foot 10 (shown in FIG. 1). With particular reference to the outsole 102 shown in FIG. 4, the midfoot region 120 of the outsole 102 is proximate and adjoining the forefoot region 118, and generally corresponds with portions of the article 100 that encase the arch of the foot 10, which includes the metatarsal bones 94 and the tarsal bones 92 (shown in FIG. 1). The heel region 122 of the outsole 102 is proximate and adjoining the midfoot region 120 and generally corresponds with portions of the article 100 that encase rear portions of the heel or calcaneus bone 90 (shown in FIG. 1), the ankle, and/or the Achilles tendon. Continuing, the outsole 102 includes a medial side 124 and a lateral side 126. In particular, the lateral side 126 corresponds with an outside portion of the article 100, and the medial side 124 corresponds to an inside portion of the article 100.

Unless otherwise specified, the forefoot region 118, the midfoot region 120, the heel region 122, the medial side 124, and the lateral side 126 are intended to define boundaries or areas of the article 100. To that end, the forefoot region 118, the midfoot region 120, the heel region 122, the medial side 124, and the lateral side 126 generally characterize sections of the article 100. Further, the outsole 102 may be characterized as having portions within the forefoot region 118, the midfoot region 120, the heel region 122, the medial side 124, and/or the lateral side 126.

Figure 2:
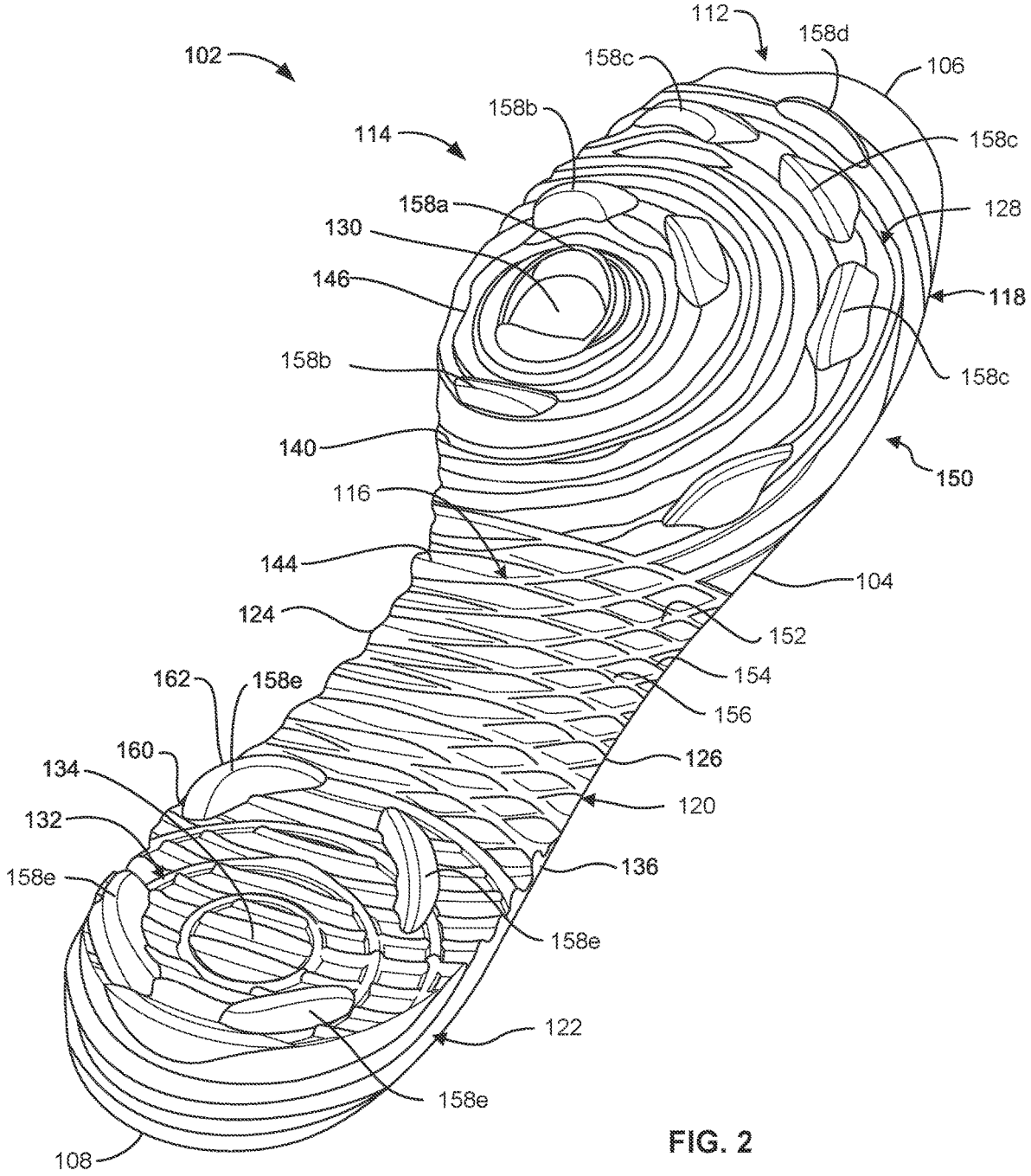
FIG. 2 is a bottom, rear, and lateral side isometric view of an outsole for an article of footwear configured as a left shoe and including a pattern, according to an embodiment of the disclosure.
Figure 3:
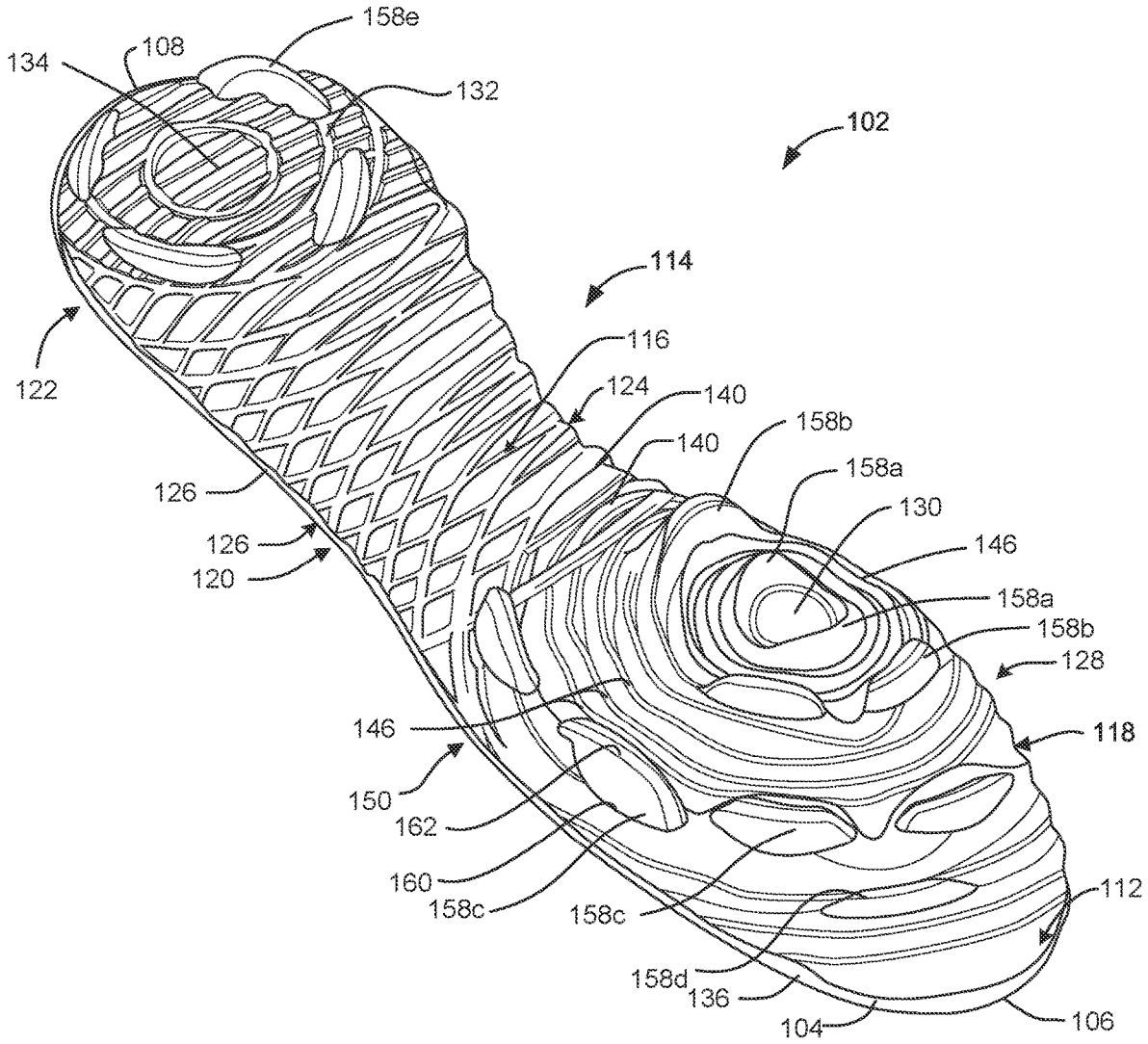
FIG. 3 is a bottom, front, and lateral side isometric view of the outsole of FIG. 2.

Referring to the outsole 102 shown in FIGS. 2 and 3, the surface pattern 114 of the ground engaging surface 112 is provided over a substantial portion of the outsole body 104 and protrudes outward in a direction opposite the top surface 110. The surface pattern 114 extends over at least a portion of each of the forefoot region 118, the midfoot region 120, and the heel region 122. In some embodiments, however, the surface pattern 114 may be provided within at least one of the forefoot region 118, the midfoot region 120, or the heel region 122.

Continuing, the surface pattern 114 of the outsole 102 comprises the plurality of circular ridges 116. As used herein, a "circular" ridge refers to a protrusion on the outsole 102 that extends in a curved line that is at least partly circular in that the curve maintains a constant distance from a center point. In some cases a circular ridge may extend around in a complete circle. In some cases, a circular ridge may extend around less than a complete circle but will maintain a constant distance from a center point.

Referring to FIGS. 5-8, the plurality of circular ridges 116 of the surface pattern 114 are configured in a wave-like pattern. The plurality of circular ridges 116 include a first set of circular ridges 128 that are concentrically aligned with and emanate outwardly from a first epicenter 130 and a second set of circular ridges 132 that are concentrically aligned and emanate outwardly from a second epicenter 134. The first epicenter 130 is located in the forefoot region 118, and the second epicenter 134 is located in the heel region 122. However, the first and second epicenters 130, 134 may be located in different regions in other embodiments.

The first epicenter 130 is spaced inwardly from the medial side 124 of the outsole 102 in the forefoot region 118, such that the first epicenter 130 is proximal to the medial side 124 and distal to the lateral side 126. The location of the first epicenter 130 can generally correspond with the location of the first metatarsal-phalangeal joint 98*a* (shown in FIG. 1).

Figure 8:
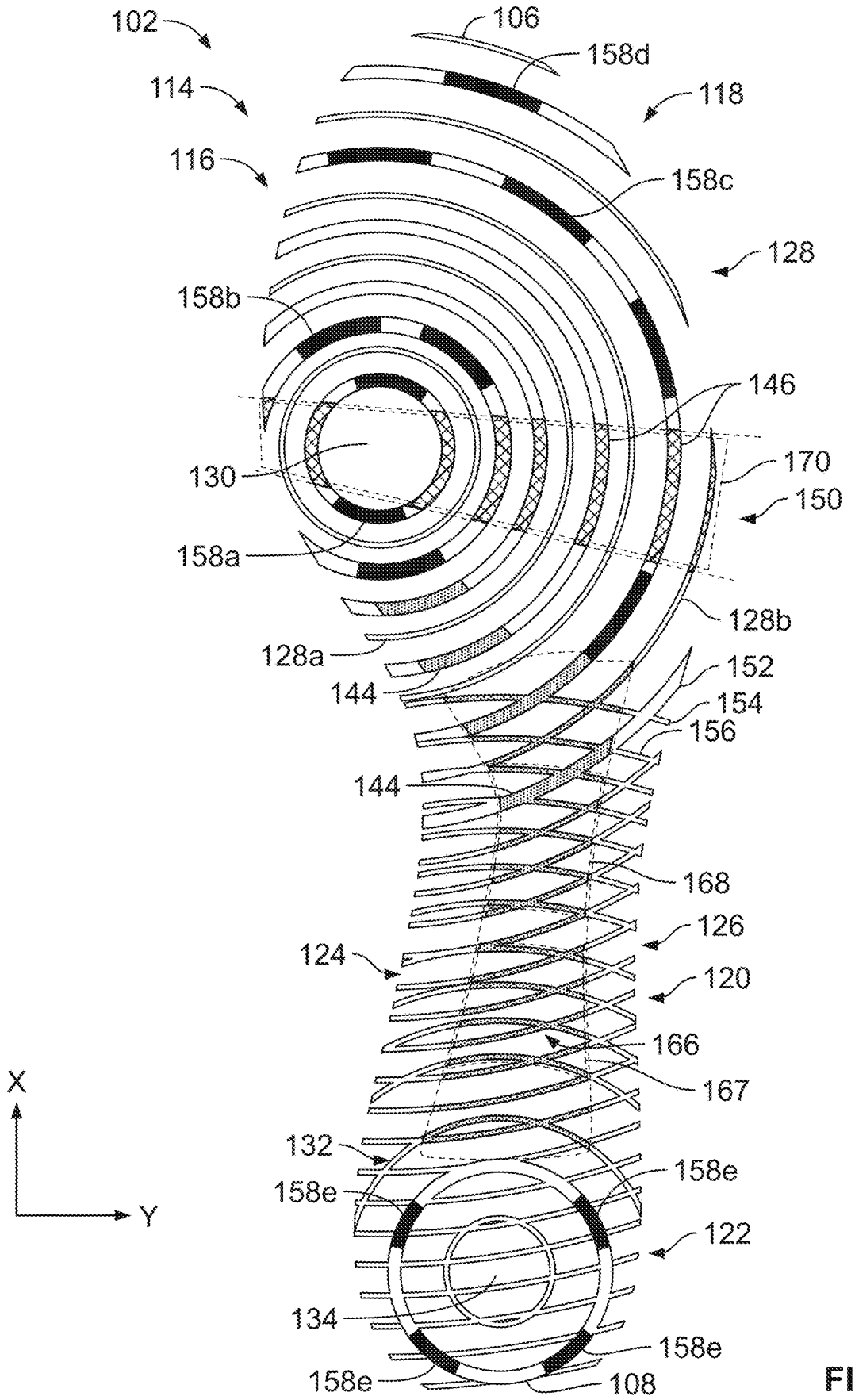
FIG. 8 is a bottom planar view showing a diagrammatic view of the outsole of FIGS. 2-7.

FIG. 8 is a schematic diagram showing a simplified version of the surface pattern 114 and is provided to more clearly illustrate the surface pattern 114 of the outsole 102. With reference to FIG. 8, the first set of circular ridges 128, or portions thereof, is located in each of the forefoot region 118, the midfoot region 120, and the heel region 122. Depending on the particular embodiment, ridges belonging to the first set of circular ridges 128 may extend into any region of the outsole 102. In general, ridges of the first set of circular ridges 128 may provide omnidirectional traction to the outsole 102 and facilitate rotational or pivotal movements of the article 100 about the first epicenter 130 (or about the first metatarsal-phalangeal joint 98*a* shown in FIG. 1). Further, any of the plurality of circular ridges 116 can assist in gripping the surface of a ball or provide soil-shedding properties.

The second set of circular ridges 132, or portions thereof, is located in each of the midfoot region 120 and the heel region 122. However, in some embodiments, the second set of circular ridges 132 can further extend into the forefoot region 118 as well. Ridges of the second set of circular ridges 132 can provide omnidirectional traction to the outsole 102 and can facilitate rotational or pivotal movements of the article 100 about the second epicenter 134 (or about the calcaneus bone 90 shown in FIG. 1).

Each ridge of the first and second set of circular ridges 128, 132 has a diameter (or radial width), and the diameter of any one ridge is proportional to its radial distance from the respective first or second epicenter 130, 134. As such, ridges of the first set of circular ridges 128 that are disposed relatively closer to the first epicenter 130 have smaller diameters (or radial widths) than outwardly-disposed ridges. Similarly, ridges of the second set of circular ridges 132 that are disposed relatively closer to the second epicenter 134 have smaller diameters (or radial widths) than outwardly-disposed ridges. In general, outwardly disposed ridges circumscribe inwardly disposed ridges. With reference to FIG. 4, for example, the first set of circular ridges 128 includes an inner ridge 128*a* and an outer ridge 128*b*. The inner ridge 128*a* is disposed inwardly relative to the outer ridge 128*b*, the diameter of the inner ridge 128*a* is less than the diameter of the outer ridge 128*b*, and the outer ridge 128*b* circumscribes the inner ridge 128*a*.

Continuing to look at FIG. 8, the ridges of the first set of circular ridges 128 can be spaced apart at predetermined distances. As shown here, the spaces between adjacent ridges in the first set of circular ridges 128 are mostly approximately equidistant. However, the outer ridges of the first set of circular ridges 128 in the forefoot region 118 are spaced apart about 1.33 times farther apart than the ridges proximal to the first epicenter 130. The larger spacing of the first set of circular ridges 128 distal to the first epicenter 130 provides more flexibility, which can be desirable in the region of the article 100 containing the phalanges 96 (shown in FIG. 1), allowing them to move and bend more freely.

The ridges of the second set of circular ridges 132 can also be spaced apart at predetermined distances. The ridges of the second set of circular ridges 132 proximal to the second epicenter 134 in the heel region 122 are spaced apart about 1.67 times farther apart than the ridges of the second set of circular ridges 132 distal to the second epicenter 134 in the midfoot region 120. The closer spacing increases the stiffness of the outsole 102 in the midfoot region 120 relative to the stiffness of the outsole 102 in the heel region 122. Additionally, or alternatively, the spacing of the ridges of the first set of circular ridges 128 and the spacing of the second set of circular ridges 132 in the midfoot region 120 can be about the same.

Figure 6A:
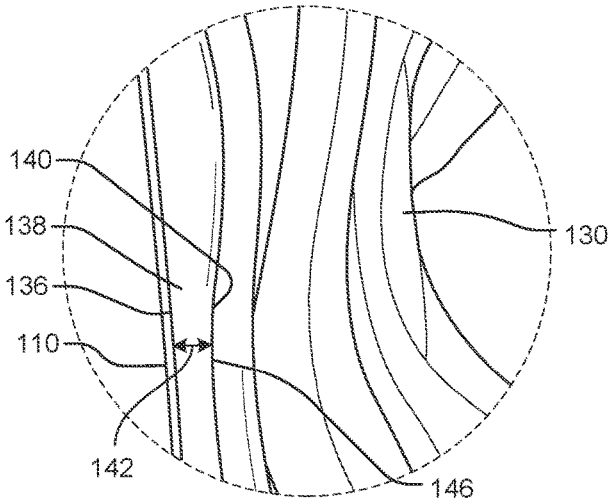
FIG. 6A is an enlarged detail view of a portion of the outsole within circle 6A of FIG. 5.
Figure 6B:
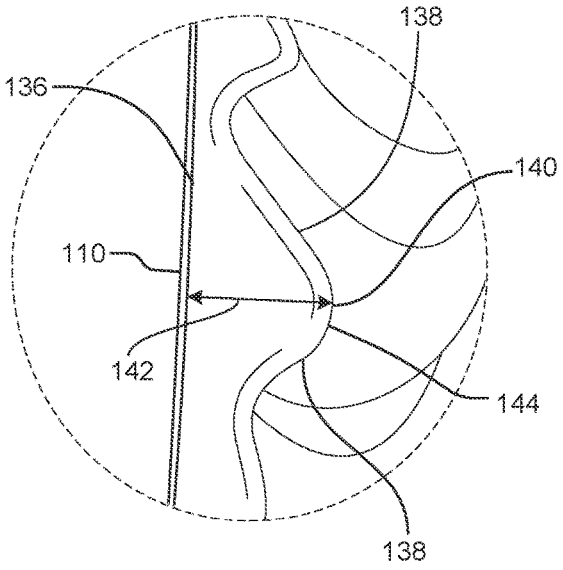
FIG. 6B is an enlarged detail view of a portion of the outsole within circle 6B of FIG. 5.
Figure 7:
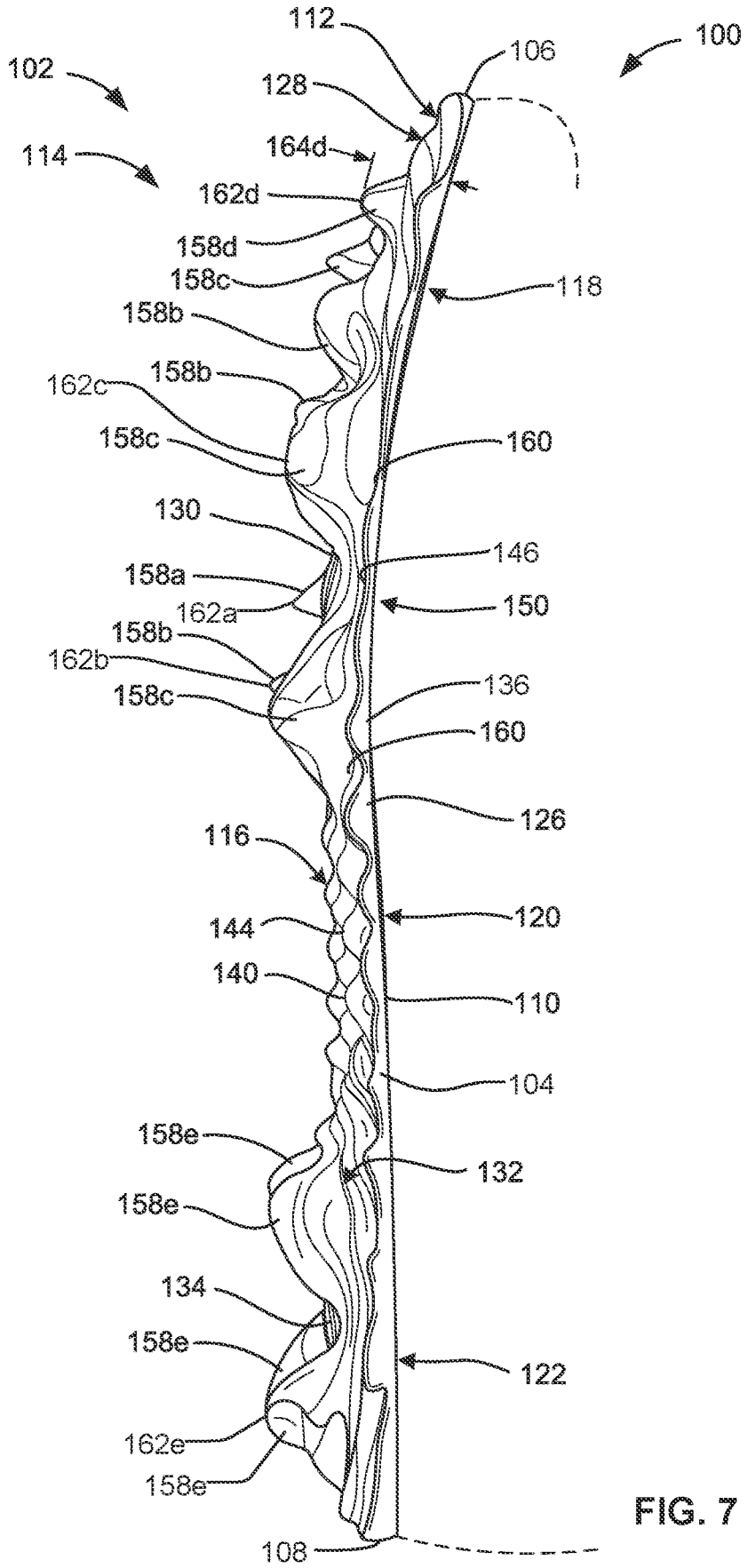
FIG. 7 is a lateral side elevation view of the outsole of FIG. 2.

As shown in FIGS. 6A and 6B, each ridge of the plurality of circular ridges 116 includes a base 136 adjacent the top surface 110, a pair of opposed side walls 138, a distal edge 140, and a height 142 defined as the straight-line distance extending perpendicularly from the base 136 to the farthest point along the distal edge 140 at any location along the ridge 116. In some embodiments, the height 142 can be in the range of about 0.1 mm to about 7.0 mm. The opposed side walls 138 taper inwardly from the base 136 toward the distal edge 140, such that each ridge of the plurality of circular ridges 116 has a substantially triangular cross section. The distal edge 140 can also be rounded as shown. However, ridges of other embodiments may be formed to have other cross-sectional shapes and sizes.

In some cases, circular ridges within the plurality of circular ridges 116 can have different heights 142. The variation in the height 142 along the circular ridge 116 can define a distal edge 140 that undulates, fluctuating between at least one tall portion 144 (shown in FIG. 6B) and at least one short portion 146 (shown in FIG. 6A). In some embodiments, the tall portion 144 can have a height 142 in the range of about 5 mm to about 7 mm. In some embodiments, the short portion 146 can have a height 142 in the range of about 0 mm to about 3 mm.

Circular ridges 116 protruding to different heights 142 may provide different stiffness properties to the outsole 102. For example, the circular ridges 116 with a height 142 at or around 7 mm will increase the stiffness of the outsole 102, whereas circular ridges 116 with a height 142 at or around 0 mm will provide less stiffness to the outsole 102. Additionally, in embodiments with circular ridges 116 with a distal edge 140 that undulates, the stiffness of the outsole 102 can be configured to be relatively greater or lower in different regions of the outsole 102 depending on the height 142 of the circular ridge 116 (discussed below) in those regions.

Figure 18:
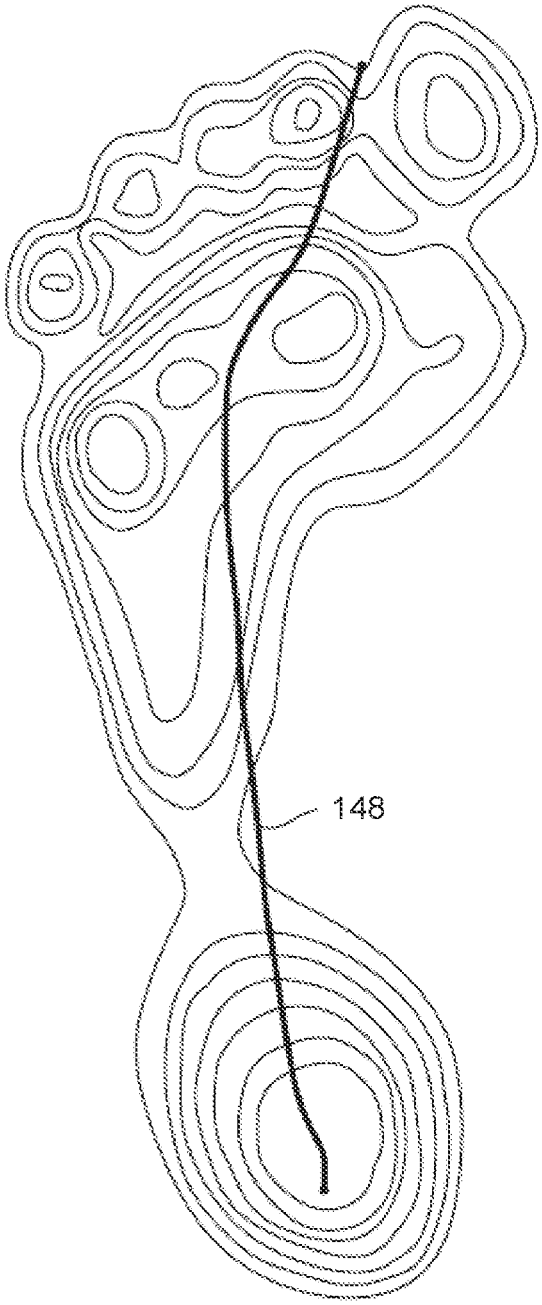
FIG. 18 is a map of force and pressure on a foot when the foot is in contact with the ground.

It is contemplated that the tall portions 144 can provide increased traction and increased stiffness to the outsole 102 along a stiffening zone 166 (shown in FIG. 8). The stiffening zone 166 includes a first group 167 of tall portions 144 and a second group 168 of tall portions 144. In some embodiments, the tall portions 144 of the plurality of circular ridges 116 can be structured and distributed in a way that provides increased bending stiffness to the midfoot region 120. For example, looking at FIG. 8, tall portions 144 of the plurality of circular ridges 116 in the midfoot region 120 are spaced inwardly from the medial side 124 and the lateral side 126 and may extend along at least a portion of a typical trajectory of a center of pressure provided by a user's foot within the article 100 (shown in FIG. 18 as line 148). The increased thickness of the outsole 102 at the tall portions 144 increases the stiffness of the outsole 102 in the midfoot region 120. Further, due to the general alignment of tall portions 144 along the center of pressure 148, tall portions 144 provide directional traction to the outsole 102 to assist movements of a user in the forward and backward directions. In other embodiments, other configurations and distributions of the tall portions 144 are possible.

Alternatively, the short portions 146 can provide less traction but increased flexibility in the outsole 102. In some embodiments, the short portions 146 can increase flexibility in the forefoot region 118 of the outsole 102 to allow for flexion of the toes 96 (shown in FIG. 1). For example, aligned short portions 146 of consecutive circular ridges of the plurality of circular ridges 116 can further define a flex zone 150 in the outsole 102 (shown in FIGS. 4 and 8). The flex zone 150 includes a first group 170 of short portions 146. With particular reference to FIGS. 4 and 8, the flex zone 150 extends laterally and rearward (i.e., toward the heel region 122), such that the flex zone 150 is disposed at an angle relative to a latitudinal axis (X-axis, shown in FIG. 8) of the outsole 102. Preferably, the location and orientation of the flex zone 150 generally corresponds with the location of at least one metatarsal-phalangeal joint 98 of a wearer (shown in FIG. 1) so that the flex zone 150 may accommodate flexion of the toes 96 (shown in FIG. 1). In some embodiments, the flex zone 150 may extend continuously between medial and lateral sides 124, 126. In some embodiments, the flex zone 150 may be discontinuous and/or comprise one or more discrete flex zone portions that do not extend completely between the medial and lateral sides 124, 126. In other embodiments, other configurations and distributions of the short portions 146 are possible. For example, short portions 146 can be provided adjacent a cleat 158

(discussed further below). This increases the relative height of the cleat 158 with respect to the surrounding areas of the ground engaging surface 112, which can increase traction.

In some embodiments, one or more ridges of the first set of circular ridges 128 may intersect with one or more ridges of the second set of circular ridges 132. Intersections between the first set and second set of circular ridges 128, 132 may increase the bending stiffness of the outsole at the location of the intersection. The intersecting ridges of the first and second set of circular ridges 128, 132 may also provide directional traction for aiding movements in the medial and lateral directions. For example, referring to FIGS. 4 and 8, the first set of circular ridges 128 includes a first ridge 152 and the second set of circular ridges 132 includes a second ridge 154. The first ridge 152 intersects the second ridge 154 in the midfoot region 120 in the stiffening zone 166. The stiffness of the midfoot region 120 is increased by virtue of the intersection of the first ridge 152 and the second ridge 154. In some cases, the second set of circular ridges 132 may further include a third ridge 156, whereby the first ridge 152 may intersect each of the second and third ridges 154, 156 in the midfoot region 120. In other embodiments, outsoles of the present disclosure may have more or fewer intersecting ridges.

The outsole 102 can also include ground engaging members or cleats on the ground engaging surface 112. In the embodiment shown in FIGS. 1 through 8, the cleats include sets of cleats, designated (where visible) with a letter (e.g., "a," "b," "c," "d," or "e") indicating the set within which the cleat is associated. Unless a particular set of cleats or an individual cleat is specifically being described, the cleats will be discussed below using only their common part number "158." A similar numbering scheme is provided for any of the constituent elements of the cleats 158. Similar to the plurality of ridges 116, the cleats 158 protrude outward in a direction opposite the top surface 110 but extend past the distal edges 140 of the plurality of circular ridges 116. The cleats 158 can provide additional traction with the ground. The cleats 158 have a base 160 adjacent the top surface 110, a distal edge 162 opposite the base 160, and a height 164 defined as the straight-line distance extending perpendicularly from the base 160 to the farthest point at the distal edge 162. In some embodiments, at least one of the cleats 158 may be integrally formed with at least one of the plurality of circular ridges 116. In those embodiments, the distal edge 162 of the cleats 158 becomes part of the undulating distal edge 140 of the respective circular ridge 116. In some embodiments, the cleats 158 can be positioned along at least one of the plurality of circular ridges 116. In some embodiments, the distal edge 162 of the cleats 158 can be aligned with the distal edge 140 of the circular ridge 116 along which the cleat 158 is positioned. In some embodiments, the base 160 of the cleats 158 can extend across multiple ridges of the plurality of circular ridges 116. In some embodiments, the cleats 158 can be removably attached to the outsole 102.

Figure 14:
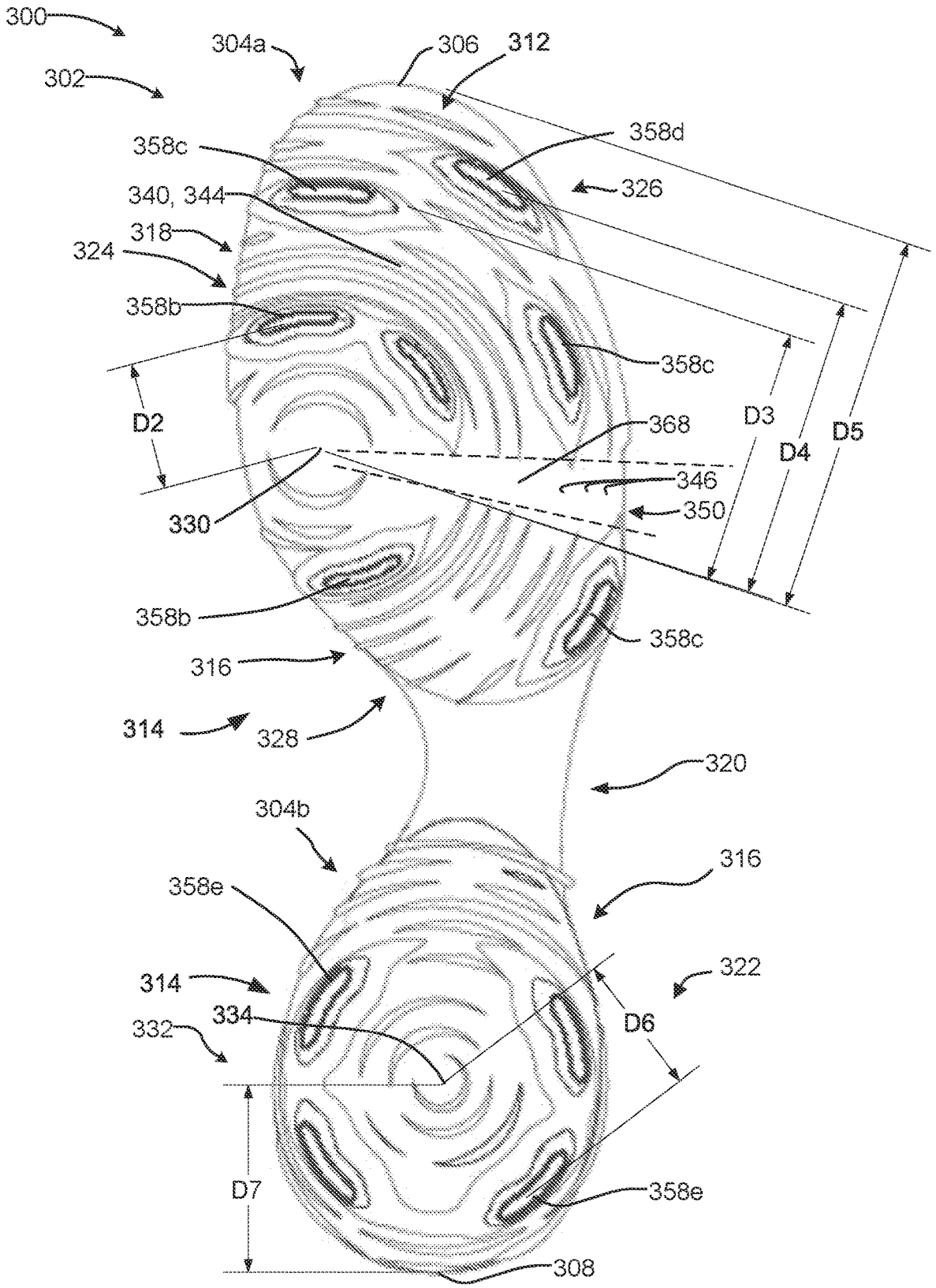
FIG. 14 is a bottom plan view of another embodiment for an outsole in accordance with the present disclosure.
Figure 15:
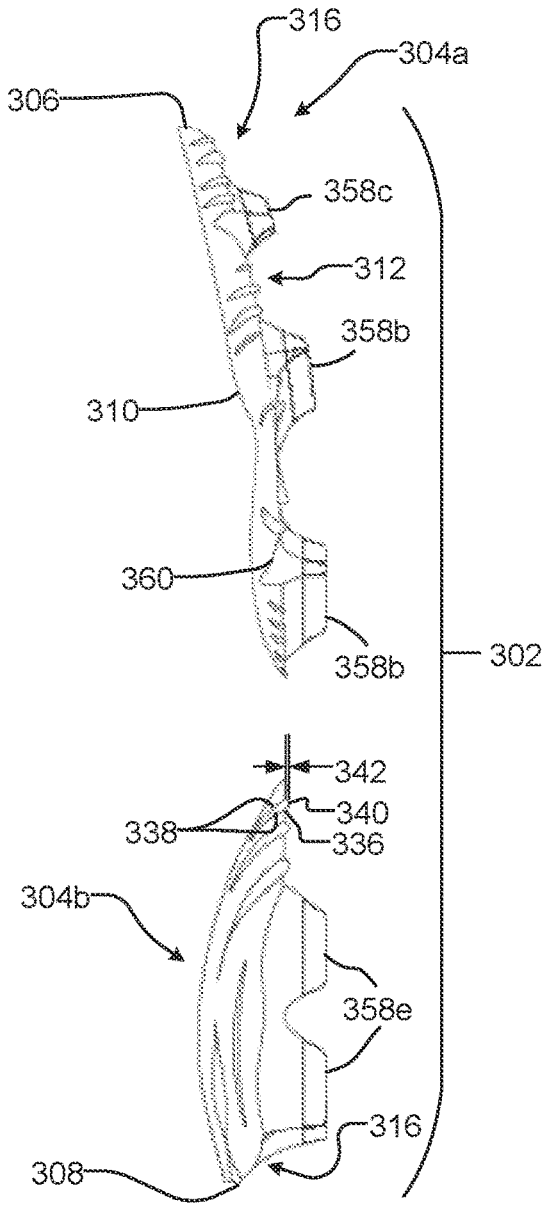
FIG. 15 is a medial side elevation view of the outsole of FIG. 14.
Figure 16:
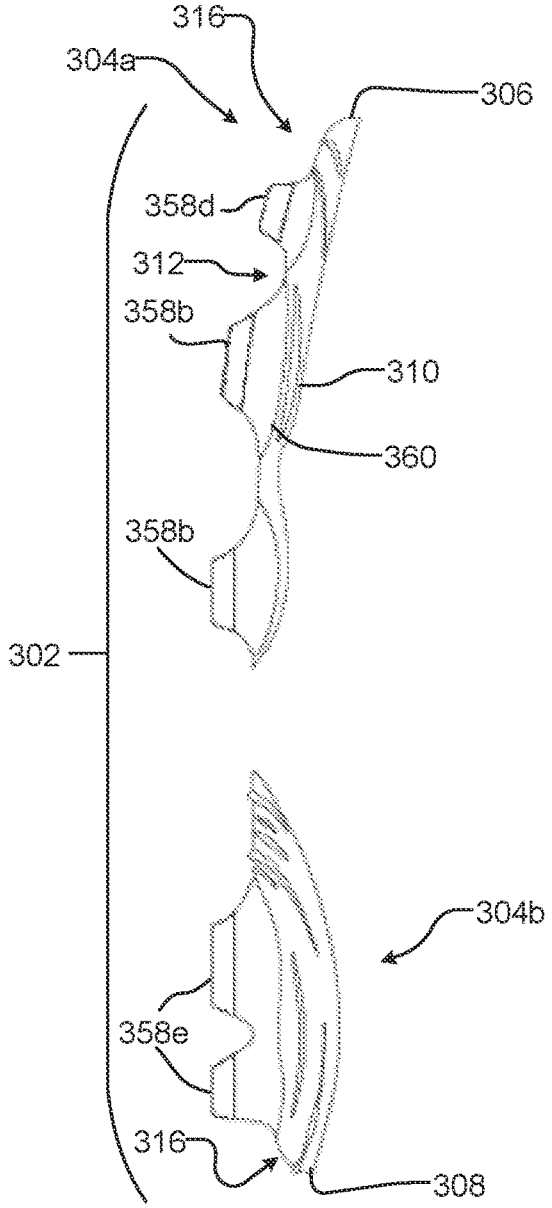
FIG. 16 is a lateral side elevation view of the outsole of FIG. 14.
Figure 17:
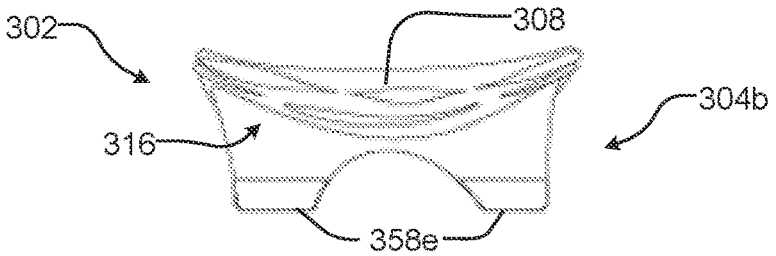
FIG. 17 is a rear elevation view of the outsole of FIG. 14.

With reference to FIG. 4, the cleats 158 may include a first set of cleats 158*a*, a second set of cleats 158*b*, a third set of cleats 158*c*, a toe cleat 158*d*, and a set of heel cleats 158*e*. However, other embodiments may include more or fewer sets of cleats. The first, second, and third sets of cleats 158*a*, 158*b*, 158*c* and the toe cleat 158*d* are radially distributed about the first epicenter 130 in the forefoot region 118, and the set of heel cleats 158*e* is radially distributed about the second epicenter 134 in the heel region 122. It is contemplated that the first, second, and third sets of cleats 158*a*, 158*b*, 158*c*, the toe cleat 158*d*, and the set of heel cleats 158*e* can be distributed in a way that reduces rotational friction with the ground during pivotal movements. For example, the first, second, and third sets of cleats 158*a*, 158*b*, 158*c* and the toe cleat 158*d* can be positioned with the respective distal edges 162*a*, 162*b*, 162*c*, 162*d* aligned with the distal edges 140 of respective associated ridges of the plurality of circular ridges 116 in the forefoot region 118. During a pivotal movement about the first epicenter 130, with the first, second, and third sets of cleats 158*a*, 158*b*, 158*c* firmly planted within the ground, a leading cleat would carve a path within the ground and the remaining cleats would follow within the path carved by the leading cleat, thus reducing the friction between the ground and the following cleats, and the cleats 158 overall. In some embodiments, not all of the cleats 158 shown in the forefoot region 118 need be present, which can reduce the rotational friction further. For example, see embodiment of another outsole 302 in FIG. 14, which includes does not include the equivalent of the first set of cleats 158*a* in the forefoot region but does include the equivalent of the second set of cleats 158*b*, the third set of cleats 158*c*, and the toe cleat 158*d* in the forefoot region.

Returning to FIG. 4, the first set of cleats 158*a* are shown laterally spaced from the first epicenter 130 a first radial distance D1, defined as the distance from the first epicenter 130 to the distal edge 162*a* of a cleat in the first set of cleats 158*a*. The second set of cleats 158*b* are laterally spaced from the first epicenter 130 a second radial distance D2, defined as the distance from the first epicenter 130 to the distal edge 162*b* of a cleat in the second set of cleats 158*b*. The third set of cleats 158*c* are laterally spaced from the first epicenter 130 a third radial distance D3, defined as the distance from the first epicenter 130 to the distal edge 162*c* of a cleat in the third set of cleats 158*c*. The toe cleat 158*d* is laterally spaced from the first epicenter 130 a fourth radial distance D4, defined as the distance from the first epicenter 130 to the distal edge 162*d* of the toe cleat 158*d*. The second radial distance D2 is greater than the first radial distance D1, whereby the second set of cleats 158*b* is radially disposed outward from the first set of cleats 158*a*. The third radial distance D3 is greater than the first and second radial distances D1, D2, whereby the third set of cleats 158*c* is radially disposed outward from the first and second sets of cleats 158*a*, 158*b*. The fourth radial distance D4 is greater than the first, second, and third radial distances D1, D2, D3, whereby the toe cleat 158*d* is radially disposed outward from the first, second, and third sets of cleats 158*a*, 158*b*, 158*c*. In some embodiments, the first, second, third, and fourth radial distances D1, D2, D3 may be provided as percentages of a toe end radial distance D5, defined as the distance from the first epicenter 130 to the toe end 106 of the outsole 102. For example, in some embodiments, the first radial distance D1 can be about 10% the toe end radial distance D5. In some embodiments, the second radial distance D2 can be about 30% the toe end radial distance D5. In some embodiments, the third radial distance D3 can be about 60% the toe end radial distance D5. In some embodiments, the fourth radial distance D4 can be about 75% the toe end radial distance D5.

Also shown in FIG. 4, the set of heel cleats 158*e* are laterally spaced from the second epicenter 134 a heel cleat radial distance D6, defined as the distance from the second epicenter 134 to the distal edge 162*e* of a cleat in the set of heel cleats 158*e*. In some embodiments, the heel cleat radial distance D6 can be provided as a percentage of a heel end radial distance D7, defined as the distance from the second epicenter 134 to the heel end 108. For example, in some embodiments, the heel cleat radial distance D6 can be about 75% the heel end radial distance D7.

Figure 5:
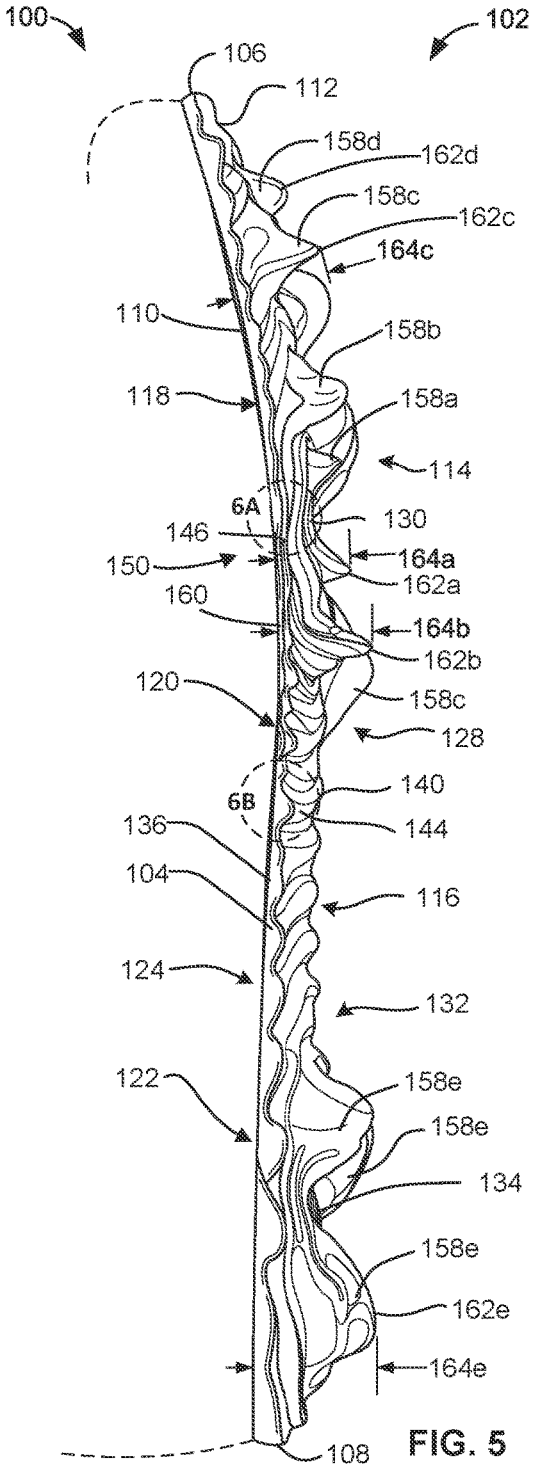
FIG. 5 is a medial side elevation view of the outsole of FIG. 2.

Continuing with the cleats 158 and looking at FIGS. 5 and 6, in some embodiments, the heights 164*a*, 164*b*, 164*c*, 164*d* of the first, second, and third sets of cleats 158*a*, 158*b*, 158*c* and the toe cleat 158*d* can be in the range of about 10 mm to about 12 mm. It is contemplated that heights 164*a*, 164*b*, 164*c*, 164*d* may differ with respect to each other. For example, the first set of cleats 158*a* may have a height 164*a* that is less than or greater than at least one of the height 164*b* of the second set of cleats 158*b*, the height 164*c* of the third set of cleats 158*c*, or the height 164*d* of the toe cleat 158*d*. In other embodiments, other variations in the heights 164*a*, 164*b*, 164*c*, 164*d* are contemplated. Further, in some embodiments, the height 164*e* of the set of rear cleats 158*e* can be about 14 mm.

With respect to the materials used to form the outsole 102, one or more materials may be used that impart durability, wear-resistance, abrasion resistance, or traction to the article of footwear 100. In some embodiments, the outsole 102 may comprise a polyurethane (PU) plastic, such as a thermoplastic polyurethane (TPU) material, for example. Other thermoplastic elastomers consisting of block copolymers are also considered. In other embodiments, the outsole 102 can include carbon fiber or high-density wood, for example. In some embodiments, the outsole 102 may be individually constructed from a thermoplastic material, such as PU, for example, and/or an ethylene-vinyl acetate (EVA), copolymers thereof, or a similar type of material. In other embodiments, the outsole 102 may be an EVA-Solid-Sponge ("ESS") material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. In some embodiments, the outsole 102 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX® plastic material. In some cases, the outsole body 104, the plurality of circular ridges 116, and the cleats 158 of the outsole 102 can be formed from substantially the same material(s). In some embodiments, at least one of the plurality of circular ridges 116 or the cleats 158 may be materially distinct from the outsole body 104.

In embodiments where the outsole 102 is formed from a supercritical foaming process, the supercritical foam may comprise micro-pore foams or particle foams, such as a TPU, EVA, PEBAX® plastic, or mixtures thereof, manufactured using a process that is performed within an autoclave, an injection molding apparatus, or any sufficiently heated/pressurized container that can process the mixing of a supercritical fluid (e.g., CO2, N2, or mixtures thereof) with a material (e.g., TPU, EVA, polyolefin elastomer, or mixtures thereof) that is preferably molten. In one example process, a solution of supercritical fluid and molten material can be pumped into a pressurized container, after which the pressure within the container is released, such that the molecules of the supercritical fluid rapidly convert to gas to form small pockets within the material and cause the material to expand into a foam, which may be used as the outsole 102. In some embodiments, the outsole 102 may be formed using alternative methods known in the art, including the use of an expansion press, an injection machine, a pellet expansion process, a cold foaming process, a compression molding technique, die cutting, or any combination thereof. For example, the outsole 102 may be formed using a process that involves an initial foaming step in which supercritical gas is used to foam a material and then compression molded or die cut to a particular shape.

FIGS. 9-13 illustrate another embodiment of an outsole 202 of an article of footwear 200 (partially shown in FIGS. 12 and 13) according to the present disclosure. In many aspects, the outsole 202 is similar to the outsole 102 described above and similar numbering in the 200 series is used for the outsole 202. For example, the outsole 202 has a toe end 206, a heel end 208, a top surface 210, and a ground engaging surface 212. The outsole 202 also generally defines a forefoot region 218, a midfoot region 220, a heel region 222, a medial side 224, and a lateral side 226.

Further, the ground engaging surface 212 has a surface pattern 214 with a plurality of circular ridges 216. The plurality of circular ridges 216 have similar attributes, placement, and spacing as the plurality of circular ridges 116 of the outsole 102 (e.g., each ridge of the plurality of circular ridges 216 includes a base 236 adjacent the top surface 210, a pair of opposed side walls 238, a distal edge 240, and a height 242 (shown in FIG. 12)) and includes a first set of circular ridges 228 that are concentrically aligned with and emanate outwardly from a first epicenter 230, spaced a distance D5 from the toe end 206, and a second set of circular ridges 232 that are concentrically aligned and emanate outwardly from a second epicenter 234, spaced a distance D7 from the heel end 208. Further, each of the plurality of circular ridges 216 have a tall portion 244 and a short portion 246, wherein an aligned number of short portions 246 define a flex zone 250. Moreover, the ground engaging surface 212 has cleats 258 with similar attributes, placement, and spacing as the cleats 158 of the outsole 102 (e.g., the cleats 258 each have a cleat base 260 and include a first set of cleats 258*a* with a first cleat distal edge 262*a* and a first cleat height 264*a*, a second set of cleats 258*b* with a second cleat distal edge 262*b* and a second cleat height 264*b*, a third set of cleats 258*c* with a third cleat distal edge 262*c* and a third cleat height 264*c*, and a toe cleat 258*d* with a toe cleat distal edge 262*d* and a toe cleat height 264*d* in the forefoot region 218 spaced radial distances D1, D2, D3, D4 from the first epicenter 230 and heel cleats 258*e* with a heel cleat distal edge 262*e* and a heel cleat height 264*e* in the heel region 222 spaced a radial distance D6 from the second epicenter 234).

Figure 9:
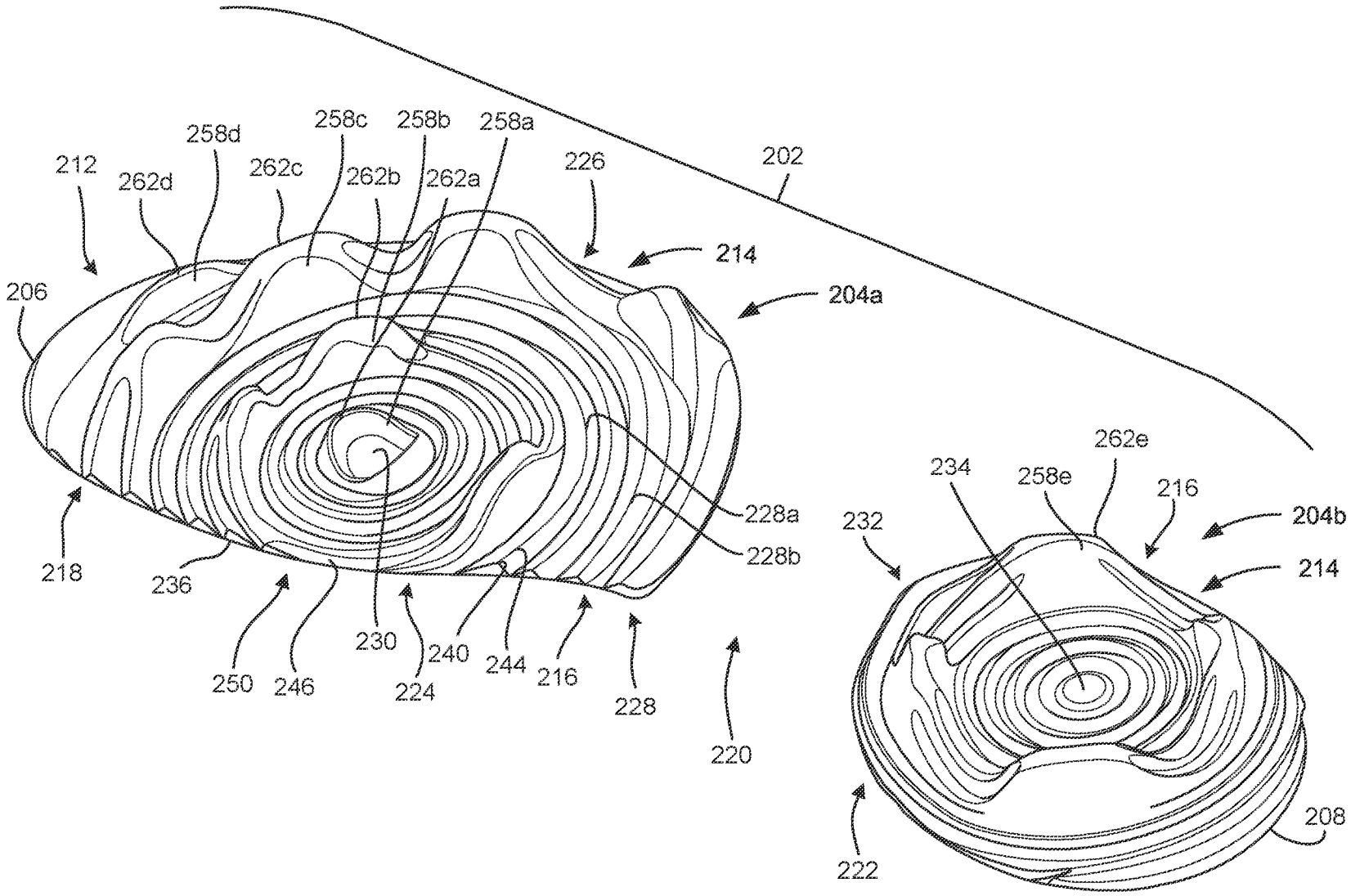
FIG. 9 is a bottom, rear, and medial side isometric view of another embodiment for an outsole in accordance with the present disclosure.
Figure 10:
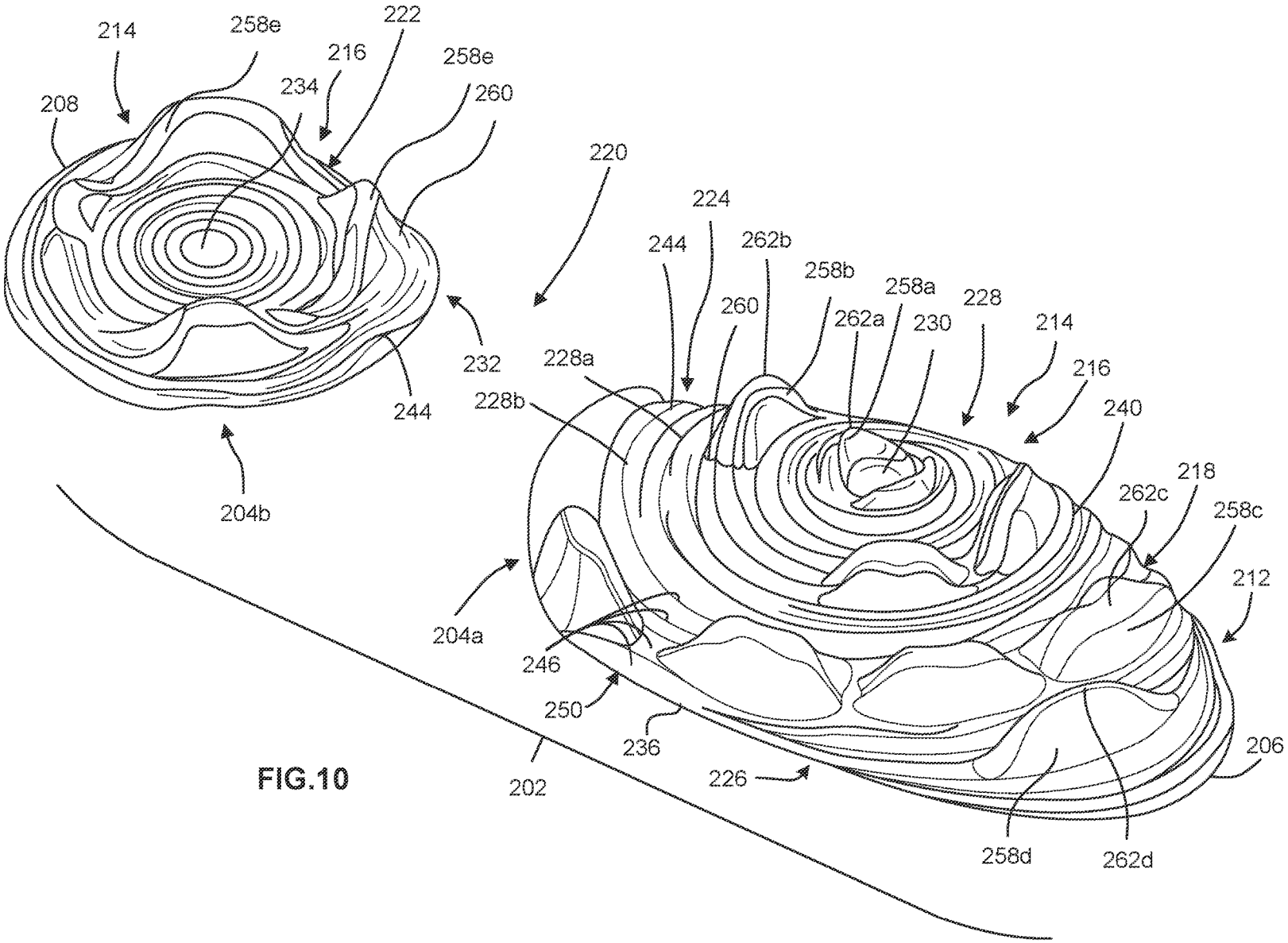
FIG. 10 is a bottom, front, and lateral side isometric view of the outsole of FIG. 9.
Figure 11:
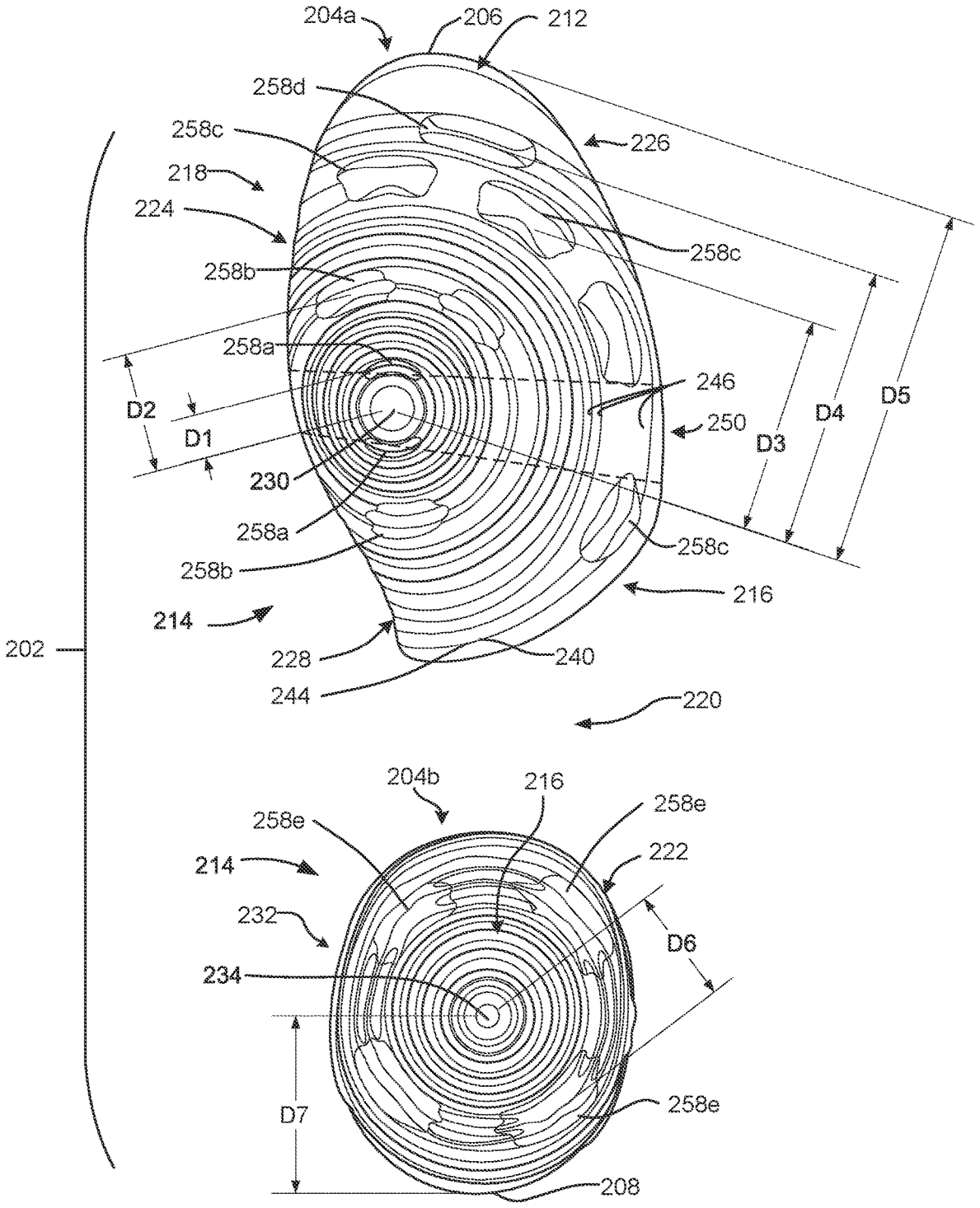
FIG. 11 is a bottom plan view of the outsole of FIG. 9.
Figure 12:
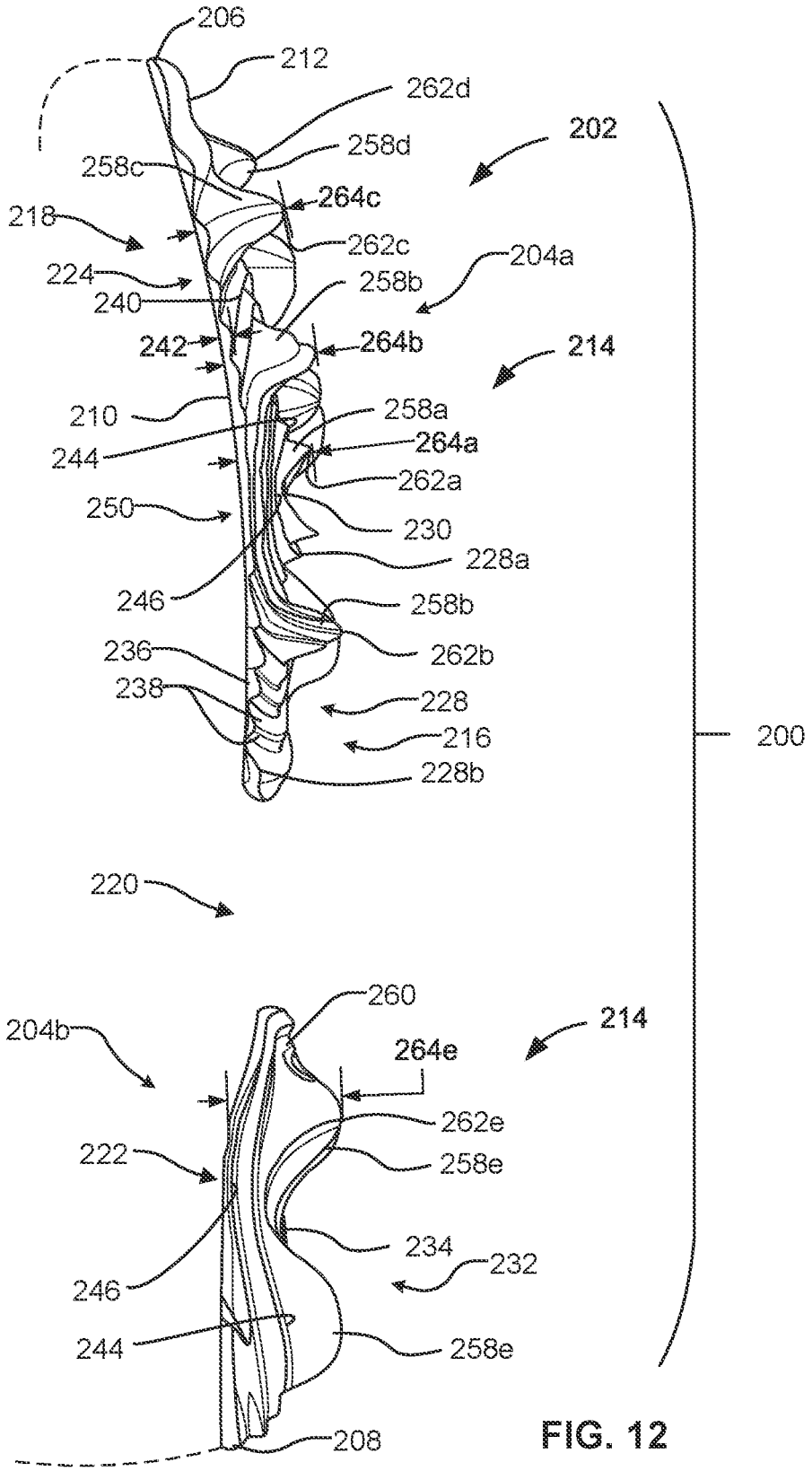
FIG. 12 is a medial side elevation view of the outsole of FIG. 9.
Figure 13:
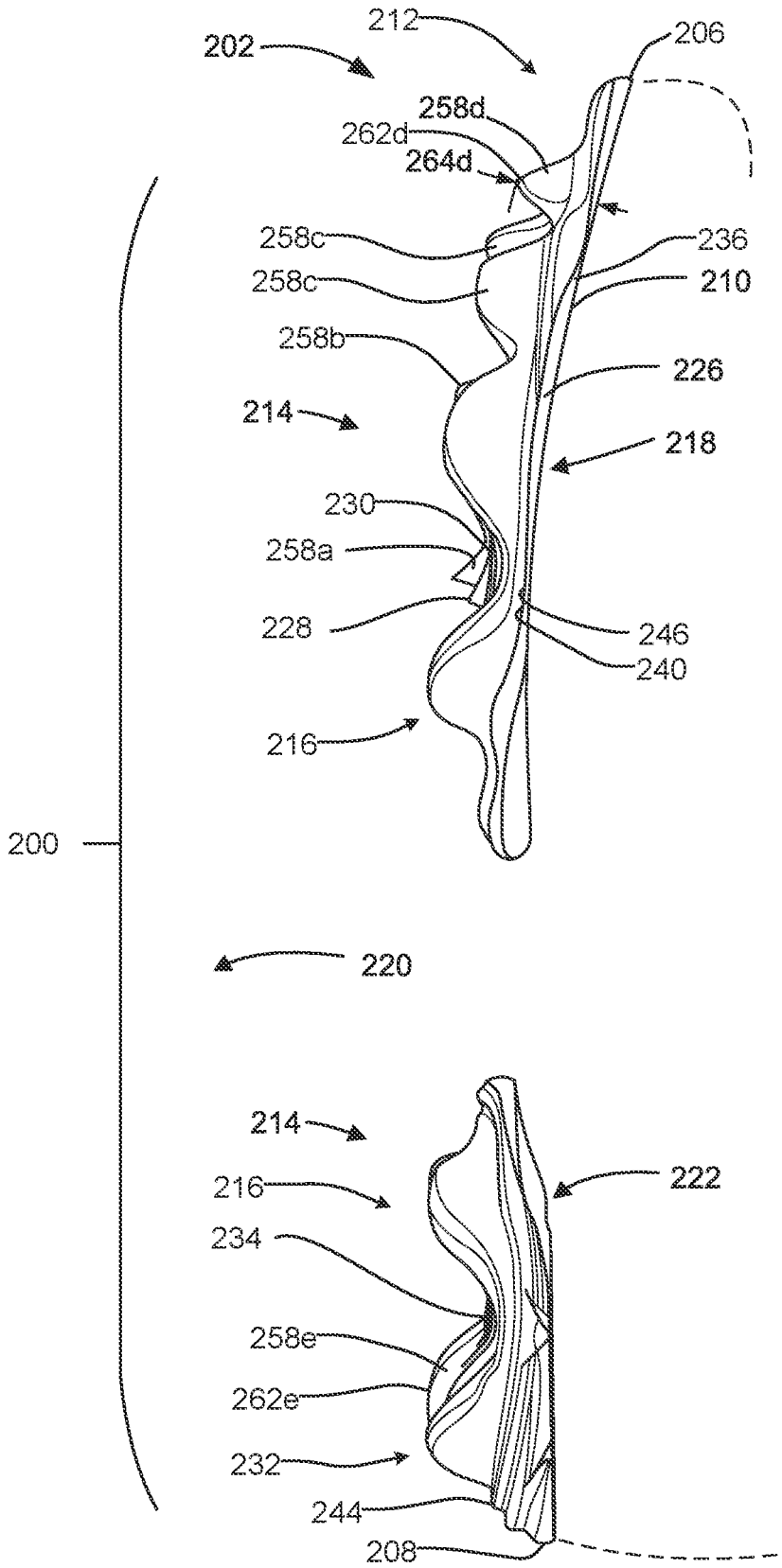
FIG. 13. is a lateral side elevation view of the outsole of FIG. 9.

In some aspects, however, the articles of footwear 100, 200 differ from each other. For example, the outsole 202 has an outsole body including a first outsole body portion 204*a* and a second outsole body portion 204*b*. The first and second outsole body portions 204*a*, 204*b* are separated from one another by a spacing in the midfoot region 220, wherein the first outsole body portion 204*a* is disposed in the forefoot region 218, the second outsole body portion 204*b* is disposed in heel region 222, and the outsole 202 does not include any adjoining structures within midfoot region 220. Further, as shown in FIG. 9, the first set of ridges 228 are contained within the forefoot region 218 on the first outsole body portion 204*a* and the second set of ridges 232 are contained within the heel region 222 on the second outsole body portion 204*b*.

Continuing, at least one of the first outsole body portion 204*a* and the second outsole body portion 204*b* may be rigid plates formed from one or more of the materials or methods discussed above with respect to the outsole body 104 to impart durability, wear-resistance, abrasion resistance, or traction to the outsole 202.

FIGS. 14-17 illustrate another embodiment of an outsole 302 of an article of footwear 300 according to the present disclosure. In many aspects, the outsole 302 is similar to the outsole 202 described above and similar numbering in the 200 series is used for the outsole 202. For example, the outsole 302 has a toe end 306, a heel end 308, a top surface 310, and a ground engaging surface 312. The outsole 302 also generally defines a forefoot region 318, a midfoot region 320, a heel region 322, a medial side 324, and a lateral side 326.

Further, the ground engaging surface 312 has a surface pattern 314 with a plurality of circular ridges 316. The plurality of circular ridges 316 have similar attributes, placement, and spacing as the plurality of circular ridges 216 of the outsole 202 (e.g., each ridge of the plurality of circular ridges 316 includes a base 336 adjacent the top surface 310, a pair of opposed side walls 338, a distal edge 340, and a height 342) and includes a first set of circular ridges 328 that are concentrically aligned with and emanate outwardly from a first epicenter 330, spaced a distance D5 from the toe end 306, and a second set of circular ridges 332 that are concentrically aligned and emanate outwardly from a second epicenter 334, spaced a distance D7 from the heel end 308. Further, the outsole 302 has an outsole body including a first outsole body portion 304*a* and a second outsole body portion 304*b* separated by a spacing in the midfoot region 330. Additionally, each of the plurality of circular ridges 316 have a tall portion 344 and a short portion 346, wherein an aligned number of short portions 346 can define a flex zone 350, and the second outsole body portion 304 has heel cleats 358*e* spaced a radial distance D6 from the second epicenter 334.

Continuing, at least one of the first outsole body portion 304*a* and the second outsole body portion 304*b* may be rigid plates formed from one or more of the materials or methods discussed above with respect to the outsole body portions 204*a*, 204*b* to impart durability, wear-resistance, abrasion resistance, or traction to the outsole 302.

In some aspects, however, the articles of footwear 200, 300 differ from each other. For example, the circular ridge 316 includes at least one short portion 346 with a height 342 of 0 mm, whereby the distal edge 340 of the short portion 346 is at the same level as the base 336 of the circular ridge 316 and defines at least one gap 368 therealong. As discussed above, gaps 368 along the circular ridge 316 can be in predetermined areas to increase the flexibility of the outsole 302 and/or decrease the traction in those areas. For example, in alignment with other gaps of adjacent circular ridges 316 to form the flex zone 350 and/or on either side of a cleat 358 to increase the relative height of the cleat 358 with respect to the surrounding areas of the ground engaging surface 312 for reasons as discussed above.

Additionally, the ground engaging surface 312 has cleats 358 with similar attributes, placement, and spacing as the cleats 258 of the outsole 202. However, the cleats 358 do not include the equivalent of the first set of cleats 258*a*, but do include similar second and third sets of cleats 358*b*, 358*c* and a toe cleat 385*d* in the forefoot region 318 spaced radial distances D2, D3, D4 from the first epicenter 330.

In other embodiments, other configurations are possible. For example, certain features and combinations of features that are presented with respect to particular embodiments in the discussion above can be utilized in other embodiments and in other combinations, as appropriate. Further, any of the embodiments described herein may be modified to include any of the structures or methodologies disclosed in connection with other embodiments. Additionally, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

The invention claimed is:

1. A sole for an article of footwear having a forefoot region, a midfoot region, a heel region, a medial side, and a lateral side, the sole comprising:

a set of ridges concentrically aligned around and emanating outwardly from an epicenter, the set of ridges extending into the midfoot region; and a set of spaces that extend concentrically between respective ridges of all ridges of the set of ridges, wherein a first group of ridges of the set of ridges has tall portions and short portions, the short portions having a height that is smaller than a height of the tall portions, wherein a stiffening zone in the midfoot region includes a first group of tall portions, such that the first group of tall portions is aligned to define the stiffening zone, and wherein a flex zone includes a first group of short portions, such that the first group of short portions is aligned to define a flex zone, wherein the flex zone is configured to flex more than the stiffening zone.

2. The sole of claim 1, wherein each ridge of the set of ridges is circular.

3. The sole of claim 1, wherein the flex zone extends from the epicenter toward the medial side, and wherein the flex zone is positioned to correspond with a location of a metatarsal-phalangeal joint of a wearer.

4. The sole of claim 1, wherein each ridge of the set of ridges is continuous.

5. The sole of claim 1, wherein an innermost ridge of the set of ridges extends completely around the epicenter.

6. The sole of claim 1, wherein the tall portions of the first group of ridges are spaced from the lateral side.

7. The sole of claim 6, wherein the short portions of the first group of ridges are positioned between the tall portions and the lateral side.

8. The sole of claim 6, wherein the sole comprises an outsole and the tall portions of the first group of ridges are formed as regions of increased thickness of the outsole and are configured to increase stiffness in the midfoot region within the stiffening zone.

9. The sole of claim 8, wherein the flex zone extends through the epicenter from a first end on the medial side to a second end on the lateral side.

10. The sole of claim 9, wherein the flex zone extends across the sole structure so that one of the first end of the flex zone and the second end of the flex zone is positioned closer to a heel end of the sole than is the other of the first end of the flex zone and the second end of the flex zone.

11. The sole of claim 9, wherein a width of the flex zone varies between the first end of the flex zone and the second end of the flex zone.

12. The sole of claim 1, wherein the spaces of the set of spaces that are between adjacent ridges are equidistant.

13. The sole structure of claim 1, wherein the epicenter is in the heel region; and wherein the stiffening zone is defined by aligned tall portions of five consecutive ridges of the set of ridges and the flex zone is defined by aligned short portions of five consecutive ridges of the set of ridges.

14. The sole structure of claim 13, wherein the set of ridges includes five ridges between the epicenter and a heel end of sole structure.

15. The sole structure of claim 14, wherein the set of ridges includes 11 ridges between the epicenter and a toe end of the sole structure.

16. The sole structure of claim 1, wherein a stiffening zone further includes a second group of tall portions spaced from the first group of tall portions.

17. The sole structure of claim 16, wherein the first group of tall portions includes four tall portions; and wherein the second group of tall portions includes four tall portions.

18. A sole for an article of footwear having a forefoot region, a midfoot region, a heel region, a medial side, and a lateral side, the sole comprising:

a set of ridges concentrically aligned around and emanating outwardly from an epicenter that is positioned in the heel region; and a set of spaces that extend concentrically between respective ridges of the set of ridges, wherein the set of ridges includes a plurality of tall portions having a height that is greater than heights of adjacent short portion, wherein some of the tall portions are aligned to define a stiffening zone in the midfoot region that is spaced from the lateral side of the sole, the stiffening zone configured to flex less than a flex zone of the sole defined by some of the short portions.

19. The sole of claim 18, wherein the tall portions are arranged to provide directional traction in a heel-to-toe direction.

20. The sole of claim 18, wherein the sole includes an outsole that defines the tall portions to increase stiffness and traction within the stiffening zone.

21. The sole of claim 20, wherein the outsole defines eight tall portions corresponding to the stiffening zone.

22. The sole of claim 21, wherein the eight tall portions are positioned in the midfoot region.

23. A sole for an article of footwear that includes a forefoot region, a midfoot region, a heel region, a medial side, and a lateral side, the sole comprising:

a ground engaging surface defining a set of ridges concentrically aligned about an epicenter in the heel region; and a set of spaces that extend between respective ridges of the set of ridges, wherein the set of ridges includes a plurality of short portions having a height that is smaller than heights of an adjacent plurality of tall portions of the set of ridges, and wherein a stiffening zone is defined by some of the plurality of tall portions and is configured to flex less than a flex zone of the sole.

24. The sole of claim 23, wherein the epicenter is a first epicenter and the set of ridges is a first set of ridges, wherein the sole further comprises a second set of ridges concentrically aligned around and emanating outwardly from a second epicenter that is disposed within the forefoot region, wherein the second set of ridges includes a plurality of short portions having a height that is smaller than heights of adjacent tall portions of the second set of ridges, and wherein the flex zone is defined by some of the plurality of short portions and is configured to flex more than the stiffening zone.

25. The sole of claim 23, where the plurality of tall portions of the set of ridges are spaced from the lateral side within the midfoot region so that the plurality of short portions is positioned between the plurality of tall portions and the lateral side.

* * * * *